US006391522B1

(12) United States Patent
Nakayama et al.

(10) Patent No.: US 6,391,522 B1
(45) Date of Patent: May 21, 2002

(54) OFFSET PRINTING PLATE PRECURSOR AND METHOD FOR OFFSET PRINTING USING THE SAME

(75) Inventors: Takao Nakayama; Kiyotaka Fukino, both of Shizuoka; Takashi Nakamura, Kanagawa; Koji Kamiyama, Kanagawa; Nobufumi Mori, Kanagawa, all of (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/421,929

(22) Filed: Oct. 21, 1999

(30) Foreign Application Priority Data

Oct. 23, 1998 (JP) ..... 10-302699
Oct. 23, 1998 (JP) ..... 10-302700

(51) Int. Cl.[7] ..... G03F 7/09

(52) U.S. Cl. ..... 430/273.1; 430/306; 430/19; 430/944; 430/945

(58) Field of Search ..... 430/19, 270.1, 430/302, 303, 306, 330, 905, 944, 945, 964, 273.1; 101/453, 454, 456, 458, 465, 466, 467, 478

(56) References Cited

U.S. PATENT DOCUMENTS 5,743,188 A * 4/1998 Ghosh et al. ..... 101/467
5,816,161 A * 10/1998 Nussel et al. ..... 101/458
5,836,249 A * 11/1998 Chatterjee et al. ..... 101/467
5,908,731 A * 6/1999 Leenders et al. ..... 430/273.1
5,925,496 A * 7/1999 Ghosh et al. ..... 430/270.1
5,985,515 A * 11/1999 Van Rompuy et al. .. 430/272.1
6,048,654 A * 4/2000 Nakayama et al. ..... 430/19
6,079,331 A * 6/2000 Koguchi et al. ..... 101/467
6,082,263 A * 7/2000 Koguchi et al. ..... 101/456
6,083,663 A * 7/2000 Vermeersch et al. ..... 430/302
6,168,903 B1 * 1/2001 Cassidy et al. ..... 430/302
6,187,508 B1 * 2/2001 Andriessen et al. ..... 430/273.1
6,210,845 B1 * 4/2001 Hotta et al. ..... 430/19

* cited by examiner

*Primary Examiner*—Janet Baxter
*Assistant Examiner*—Barbara Gilmore
(74) *Attorney, Agent, or Firm*—Burns, Doane, Swecker & Mathis, LLP

(57) ABSTRACT

An offset printing plate precursor comprising a substrate having provided thereon a layer containing a substance capable of absorbing radiant rays and converting the radiant energy to heat energy, and a thin layer, wherein printing is performed by following the steps of:

(a) subjecting the printing plate precursor to irradiation with active light, (b) subjecting the printing plate precursor to irradiation with light/heat convertible radiant rays or heat treatment, to thereby imagewise distribute a hydrophilic area and a lipophilic area of the thin layer, and (c) bringing the thin layer into contact with printing ink to form a printing plate in which the lipophilic area has received the printing ink, to thereby perform offset printing.

15 Claims, 4 Drawing Sheets

OFFSET PRINTING PLATE PRECURSOR AND METHOD FOR OFFSET PRINTING USING THE SAME

FIELD OF THE INVENTION

The present invention relates to general printing field, in particular, offset printing, and a novel offset printing method in which a printing plate can be easily formed, and an offset printing plate. Specifically the present invention relates to an offset printing method capable of replication reclamation of a printing plate precursor and a printing plate precursor.

BACKGROUND OF THE INVENTION

The offset printing method has been generally used and has become a primary printing means at present because a manufacturing process of a printing plate is simple among various printing methods. This printing technique is based on the incompatibility of oil and water. An oily material, i.e., ink, is retained in an image area and a fountain solution is retained in a non-image area selectively. By bringing an ink carrying-printing plate into contact with a part to be printed directly or indirectly via an intermediate which is called blanket, the ink on the image area is transferred to the part to be printed, thereby printing is performed.

The offset printing method mainly comprises a PS plate comprising an aluminum substrate as a support having coated thereon a diazo photosensitive layer. The aluminum support of a PS plate is surface-grained and anodized to heighten the ink receptivity of the image area and ink repellency of the non-image area through other various processes to thereby improve the press life and contrive accuracy of the printing plate. Accordingly, the offset printing is provided with press life and high accuracy of the printing plate in addition to simplicity.

However, further simplification of the offset printing technique has been required with the prevalence of printed matters and a variety of simple printing methods have been proposed.

Representative examples thereof are copy rapid offset printing plate commercially available from Agfa-Gevaert Co. and a printing method based on printing plate making by means of a silver salt diffusion transfer process as disclosed in U.S. Pat. No. 3,511,656 and JP-A-7-56351 (the term "JP-A" as used herein means an "unexamined published Japanese patent application"). This method has been put to practical use as a simple printing method because a lipophilic transfer image can be formed through one step according to this method, hence the image can be used as a printing plate as it is. However, this method also includes diffusion transfer development process with an alkaline developing solution, although it is simple. Therefore, a further simpler printing method which necessitates no development process with a developing solution has been demanded.

From the above background, a simpler printing plate-making method without performing development with an alkaline developing solution after image exposure has been developed. This simpler printing plate is called a non-processing printing plate because a development process is excluded and many improved methods have been proposed. Every sort and kind of means based on various principles, e.g., (1) image formation by thermal destruction of the irradiated part on image recording surface by imagewise exposure, (2) image formation by lipophilization (heat mode hardening) of the irradiated part by imagewise exposure, (3) image formation by lipophilization (light mode hardening) of the irradiated part by imagewise exposure, (4) decomposition of surface property by photolysis of a diazo compound, and (5) heat transfer of the image area by heat mode melting have been suggested.

The above simple offset printing techniques are disclosed in U.S. Pat. Nos. 3,506,779, 3,549,733, 3,574,657, 3,739,033, 3,832,948, 3,945,318, 3,962,513, 3,964,389, 4,034,183, 4,081,572, 4,693,958, 731,317, 5,238,778, 5,353,705, 5,385,092, 5,395,729 and European Patent 1068.

These techniques do not require a developing solution at plate-making but they have at least one of the drawbacks that the difference between a hydrophilic area and a lipophilic area is insufficient, consequently the image quality of the printed image is inferior, that the resolving power is inferior, consequently a printed image plane having excellent sharpness can hardly be obtained, that the image surface is insufficient in mechanical strength and is liable to be damaged, resulting in the necessity of the provision of a protective film, consequently the simplicity is rather lost, and that the durability capable of enduring long term printing is insufficient. These facts show that only the exclusion of an alkali developing process does not lead to the solution of the problem. Thus, a method for making a printing plate which fulfills requisite characteristics for printing and can easily produce a printing plate has been strongly demanded but such a method has not been realized yet.

On the other hand, along with the simplification of a printing method represented by a non-processing printing plate, reclaiming of used printing plate precursors for recycling is advantageous to the reduction of the costs and wastes and to environmental protection. However, the reclamation and reuse of printing plate precursors are accompanied by various difficulties hence these have been hardly given serious consideration, and only a special material for a printing precursor which is called zirconia ceramic is disclosed in JP-A-9-169098. Zirconia ceramic is, however, insufficient in light sensitivity and light conversion effect from hydrophobicity to hydrophilicity is unsatisfactory, therefore discrimination of an image area from a non-image area is insufficient.

In the above circumstances, the present inventors have proposed a printing plate precursor composed of a thin layer of specific metallic oxides belonging to group II, IV, or V of the Periodic Table, e.g., titanium oxide, and a printing method using the same in JP-A-11-78272, JP-A-11-105234 and Japanese Patent Application Nos. 9-258784, 9-308822, 9-308823, 9-313740, 9-348077, and 9-348078. This is a non-processing printing plate precursor which can be easily reclaimed and is excellent in simplicity, economization and environmental suitability but the present inventors have found that this printing plate precursor is inferior in ink stain of the printed paper when repeatedly used in comparison with the printed paper obtained by using a new printing plate precursor. Therefore, it has been desired to develop a method which generates little ink stain with repeated use of the printing plate precursor and which can maintain the printing quality of the printed paper in the initial printing.

This printing plate precursor has a thin layer the surface of which becomes hydrophilic with the irradiation of active light and becomes lipophilic by absorbing light energy, and the above-described simplicity and environmental suitability of this printing plate precursor are satisfied due to this constitution. However, it is desired to further increase the sensitivity to active light and the sensitiveness of the transformation of the physical properties of the thin layer surface by heat energy absorption to heighten the ink-receptivity and ink-repellency of the printing plate precursor to thereby improve the printing quality of the printed paper.

SUMMARY OF THE INVENTION

Accordingly, an object of the present invention is to improve the above-described non-processing printing plate precursor having a thin layer composed of a specific metallic oxide, specifically an object is to provide a printing plate precursor having high sensitivity to active light, having high sensitiveness of the transformation of the physical properties of the surface by heat energy absorption, hence hydrophilicity and lipophilicity are highly discriminable, and excellent in ink-receptivity and ink-repellency.

Another object of the present invention is to improve the above-described non-processing printing plate precursor having a thin layer composed of a specific metallic oxide which can be reclaimed repeatedly, specifically another object is to provide an offset printing means which generates little ink stain of the printed paper when the printing plate precursor is reused and can maintain the printing quality of the printed paper even when the printing plate precursor is repeatedly used, consequently to provide an offset printing means capable of increasing the number of times of the capability of repeating use of the printing plate precursor.

The present inventors have searched for a recording method having high heat-response for achieving the above objects. As a result, the present inventors have found that the response sensitivity of the transformation of the surface physical properties due to the action of heat increases by providing, as an auxiliary layer, a radiation ray-absorbing layer just under a photosensitive layer. As a result of further investigation based on this fact, the present invention has been attained.

Moreover, for achieving the above objects, the present inventors have eagerly examined the cause of ink stain, and have elucidated that ink stain was caused by the ink remaining on the used printing plate precursor which could not be completely removed by cleaning. Based on this fact, the present inventors have searched for a means to exclude the ink from the printing plate, thus the present invention has been achieved.

That is, the present invention has been achieved by the following means.

(1) An offset printing plate precursor comprising a substrate having provided thereon a thin layer, wherein printing is performed by following the steps of:

(a) subjecting the printing plate precursor to irradiation with active light, (b) subjecting the printing plate precursor to irradiation with light/heat convertible radiant rays or heat treatment, to thereby imagewise distribute a hydrophilic area and a lipophilic area of the thin layer, and (c) bringing the thin layer into contact with printing ink to form a printing plate in which the lipophilic area has received the printing ink, to thereby perform offset printing.

(2) The offset printing plate precursor as described in the above item (1), wherein printing is performed by following the steps of (a) subjecting the printing plate precursor to irradiation with active light, (b) subjecting the printing plate precursor to irradiation with light/heat convertible radiant rays, to thereby imagewise distribute a hydrophilic area and a lipophilic area of the thin layer, and (c) bringing the thin layer into contact with printing ink to form a printing plate in which the lipophilic area has received the printing ink, to thereby perform offset printing, wherein a layer containing a substance capable of absorbing radiant rays and converting the radiant energy to heat energy is provided between the thin layer and the substrate and in contact with the thin layer.

(3) The offset printing plate precursor as described in the above item (2), wherein the thin layer provided on the substrate is a thin layer composed of at least one compound selected from the group consisting of $TiO_2$, $RTiO_3$ (wherein R represents an alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to metal elements of Group V-A of the Periodic Table, E represents a metal atom belonging to metal elements of Group IV of the Periodic Table, and x represents an arbitrary numerical value of from 0 to 2), $SnO_2$, $Bi_2O_3$, and $Fe_2O_3$.

(4) The offset printing plate precursor as described in the above item (2), wherein the substance capable of absorbing radiant rays and converting the radiant energy to heat energy is a metal or a metal compound accompanied by a self exothermic reaction.

(5) The offset printing plate precursor as described in the above item (2), wherein the printing plate precursor can be restored to the original condition before use and repeatedly used by removing the remaining ink on the printing plate after printing has been finished by cleaning and then heating the surface of the plate precursor at 80° C. or higher.

(6) The offset printing plate precursor as described in the above item (1), wherein printing is performed by following the steps of (a) subjecting the printing plate precursor to irradiation with active light, (b) subjecting the printing plate precursor to heat treatment, to thereby imagewise vary the degree of hydrophilicity and lipophilicity of the thin layer, and (c) bringing the thin layer into contact with printing ink to form a printing plate in which the lipophilic area has received the printing ink, to thereby perform offset printing, wherein the thin layer provided on the substrate is a thin layer composed of at least one compound selected from the group consisting of $TiO_2$, $RTiO_3$ (wherein R represents an alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to metal elements of Group V-A of the Periodic Table, E represents a metal atom belonging to metal elements of Group IV of the Periodic Table, and x represents an arbitrary numerical value of from 0 to 2), $SnO_2$, $Bi_2O_3$, and $Fe_2O_3$, and the surface of the thin layer is a scabrous surface comprising concavities and convexities having an arithmetic mean pore diameter calculated in terms of a circle of the concavities of at least 1.0 $\mu$m.

(7) The offset printing plate precursor as described in the above item (6), wherein printing is performed by following the steps of (a) subjecting the printing plate precursor to irradiation with active light, (b) subjecting the printing plate precursor to heat treatment, to thereby imagewise vary the degree of hydrophilicity and lipophilicity of the thin layer, and (c) bringing the thin layer into contact with printing ink to form a printing plate in which the lipholic area has received the printing ink, to thereby perform offset printing, wherein the printing plate precursor can be restored to the original condition before use and repeatedly used by removing the remaining ink on the printing plate after printing has been finished by cleaning and then heating the surface of the plate precursor at 80° C. or higher.

(8) An offset printing method which comprises:

(a) subjecting a printing plate precursor to irradiation with active light, (b) subjecting a printing plate precursor to irradiation with light/heat convertible radiant rays or heat treatment, to thereby imagewise distribute a hydrophilic area and a lipophilic area of a thin layer provided on a substrate, and (c) bringing the thin layer into contact with printing ink to form a printing plate in which the lipophilic area has received the printing ink, to thereby perform offset printing.

(9) The offset printing method as described in the above item (8), which comprises (a) subjecting a printing plate precursor to irradiation with active light, (b) subjecting a printing plate precursor to irradiation with light/heat convertible radiant rays, to thereby imagewise distribute a hydrophilic area and a lipophilic area of the thin layer provided on the surface of the printing plate precursor, and (c) bringing the thin layer into contact with printing ink to form a printing plate in which the lipophilic area has received the printing ink, to thereby perform offset printing, wherein a layer containing a substance capable of absorbing radiant rays and converting the radiant energy to heat energy is provided between the thin layer and the substrate and in contact with the thin layer.

(10) The offset printing method as described in the above item (9), wherein the thin layer is a thin layer composed of at least one compound selected from the group consisting of $TiO_2$, $RTiO_3$ (wherein R represents an alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to metal elements of Group V-A of the Periodic Table, E represents a metal atom belonging to metal elements of Group IV of the Periodic Table, and x represents an arbitrary numerical value of from 0 to 2), $SnO_2$, $Bi_2O_3$, and $Fe_2O_3$.

(11) The offset printing method as described in the above item (9) , wherein the substance capable of absorbing radiant rays and converting the radiant energy to heat energy is a metal or a metal compound accompanied by a self exothermic reaction.

(12) The offset printing method as described in the above item (9), wherein the printing plate precursor can be restored to the original condition before use and repeatedly used by removing the remaining ink on the printing plate after printing has been finished by cleaning and then heating the surface of the plate precursor at 80° C. or higher.

(13) The offset printing method as described in the above item (9), which comprises the steps of:

(a) subjecting all over the surface of the thin layer on the surface of the printing plate precursor to irradiation with active light to make all over the surface of the thin layer hydrophilic, (b) subjecting the surface of the thin layer to imagewise irradiation with light/heat convertible radiant rays to make the irradiated part lipophilic, and (c) bringing the surface of the thin layer into contact with printing ink to form a printing plate in which the lipophilic area has received the printing ink, to thereby perform offset printing.

(14) The offset printing method as described in the above item (9) , wherein the printing plate precursor is repeatedly used by following the steps of:

(a) subjecting all over the surface of the thin layer on the surface of the printing plate precursor to irradiation with active light to make all over the surface of the thin layer hydrophilic, (b) subjecting the surface of the thin layer to imagewise irradiation with light/heat convertible radiant rays to make the irradiated part lipophilic, (c) bringing the surface of the thin layer into contact with printing ink to form a printing plate in which the lipophilic area has received the printing ink, to thereby perform offset printing, (d) removing the remaining ink on the surface of the thin layer after printing has been finished by cleaning, and (e) heating the surface of the thin layer at 80° C. or higher, thereby all over the surface of the thin layer is restored to its lipophilic condition.

It is also the characteristic of the offset printing material of the present invention to repeatedly use the printing plate precursor by utilizing the reversible variable property of hydrophilicity and lipophilicity of the printing plate precursor as follows.

(15) The offset printing method as described in the above item (9) , wherein the printing plate precursor is repeatedly used by following the steps of:

(a) imagewise distributing a hydrophilic area and a lipophilic area on the thin layer provided on the surface of the printing plate precursor, (b) bringing the thin layer into contact with printing ink to form a printing plate in which the lipophilic area has received the printing ink, to thereby perform offset printing, (c) removing the remaining ink on the printing plate after printing has been finished by cleaning, and (d) heating the surface of the plate precursor at 80° C. or higher, thereby the printing plate precursor can be restored to the original condition before use.

(16) The offset printing method as described in the above item (9), wherein the printing plate precursor is repeatedly used by following the steps of:

(a) subjecting all over the surface of the thin layer provided on the surface of the printing plate precursor to irradiation with active light to make all over the surface of the thin layer hydrophilic, (b) subjecting the surface of the thin layer to imagewise irradiation with light/heat convertible radiant rays to make the irradiated part lipophilic, (c) bringing the surface of the thin layer into contact with printing ink to form a printing plate in which the lipophilic area has received the printing ink, to thereby perform offset printing, (d) removing the remaining ink on the printing plate after printing has been finished by cleaning, and (e) heating the surface of the plate precursor at 80° C. or higher, thereby the printing plate precursor can be restored to the original condition before use.

(17) The offset printing method as described in the above item (8), wherein the printing plate precursor is repeatedly used by following the steps of:

(a) subjecting the printing plate precursor to irradiation with active light, (b) subjecting the printing plate precursor to heat treatment, to thereby imagewise distribute a hydrophilic area and a lipophilic area of the thin layer, (c) bringing the thin layer into contact with printing ink to form a printing plate in which the lipophilic area has received the printing ink, to thereby perform offset printing (d) removing the remaining ink on the printing plate after printing has been finished by cleaning, and (e) heating the surface of the plate precursor at 80° C. or higher, thereby the plate precursor is restored to the original condition before use and repeatedly used.

(18) The offset printing method as described in the above item (17), wherein the printing plate precursor is repeatedly used by following the steps of:

(a) subjecting all over the surface of the thin layer on the surface of the printing plate precursor to irradiation with active light to make all over the surface of the thin layer hydrophilic, (b) subjecting the surface of the thin layer to imagewise heating to make the irradiated part lipophilic, (c) bringing the surface of the thin layer into contact with printing ink to form a printing plate in which the lipophilic area has received the printing ink, to thereby perform offset printing, (d) removing the remaining ink on the surface of the thin layer after printing has been finished by cleaning, and (e) heating the surface of the thin layer at 80° C. or higher, thereby all over the surface of the thin layer is restored to its lipophilic condition.

(19) The offset printing method as described in the above item (17), wherein the printing plate precursor is repeatedly used by following the steps of:

(a) subjecting the surface of the thin layer on the surface of the printing plate precursor to imagewise irradiation with active light to make the irradiated part of the thin layer hydrophilic, (b) bringing the surface of the thin layer into contact with printing ink to form a printing plate in which the lipophilic area has received the printing ink, to thereby perform offset printing, (c) removing the remaining ink on the surface of the thin layer after printing has been finished by cleaning, and (d) heating the surface of the thin layer at 80° C. or higher, thereby all over the surface of the thin layer is restored to its lipophilic condition.

(20) The offset printing method as described in the above item (8), wherein the active light for use in imagewise irradiation is laser beam.

The present invention is the improved invention based on the non-processing printing plate precursor having a thin layer composed of a substance which becomes hydrophilic by the irradiation with active light, in particular a thin layer composed of the above-described specific metallic oxide, and the printing method using the same as the fundamental techniques, and the object has been achieved by the existence of a substance capable of absorbing radiant rays and converting the radiant energy to heat energy for further improving the heat energy-response.

The fundamental invention is a method for producing a non-processing printing plate for offset printing and a printing plate precursor for use in the method, which has been attained on the basis of the characteristic physical properties of a thin layer composed of a specific metallic oxide, i.e., imagewise distribution of a hydrophilic area and a lipophilic area was formed by making use of the properties of the metallic oxide that (1) the surface of the thin layer is converted to hydrophilic by the irradiation with active light, and (2) the surface of the thin layer is converted to lipophilic by heating, and this thin layer was employed as the ink-receiving area and the ink-repelling area. Further, the fundamental invention also involves a method for reclaiming used printing plate precursors for recycling by utilizing the foregoing characteristics of conversion by heating of the surface physical properties of the thin layer. As described above, the foregoing fundamental techniques are disclosed in by JP-A-11-28272, etc.

As compared with the fundamental invention, the present improved invention is an invention of a printing method and a printing plate precursor which comprises a layer containing a substance having a function capable of absorbing light/heat convertible radiant rays and converting the radiant energy to heat energy (hereinafter referred to as "light/heat conversion) provided just under the image-recording layer. The present invention aims at improving image-forming sensitivity and ink-receptivity concurrently.

Accordingly, the constitution of the offset printing plate precursor according to the present invention comprises a substrate having provided thereon a layer containing a light/heat convertible substance, and thereon a thin layer which becomes hydrophilic with the irradiation of active light and becomes lipophilic by the function of light/heat convertible radiant rays, in particular a specific metallic oxide described later.

Another characteristic of the fundamental invention is that a printing plate precursor can be restored to the original condition before use and repeatedly used by removing the remaining ink on the printing plate after printing has been finished by cleaning and then heating the surface of the plate precursor at 80° C. or higher, and the present invention has succeeded to this characteristic.

Further, the present invention has been improved in reducing stain due to printing by using, as fundamental techniques, the non-processing printing plate precursor having the above-described specific metallic oxide thin layer on a printing plate surface and the printing method using the same.

The fundamental technique is to use a printing plate precursor, wherein the thin layer provided on the substrate is a thin layer composed of at least one compound selected from the group consisting of $TiO_2$, $RTiO_3$ (wherein R represents an alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to elements of Group V-A of the Periodic Table, E represents a metal atom belonging to elements of Group IV of the Periodic Table, and x represents an arbitrary numerical value of from 0 to 2), $SnO_2$, $Bi_2O_3$, and $Fe_2O_3$, and the degree of hydrophilicity and lipophilicity of the thin layer is imagewise varied by irradiation with active light and heat treatment, then the thin layer is brought into contact with printing ink to form a printing plate in which the lipophilic area has received the printing ink, and the remaining ink on the printing plate after printing has been finished is removed by cleaning and the surface of the plate precursor is then heated at 80° C. or higher, thereby the printing plate precursor which can be repeatedly used can be restored to the original condition before use.

That is, a thin layer composed of a specific metallic oxide is characterized in that the surface property thereof becomes hydrophilic by irradiation with active light and the converted surface property is restored to the original hydrophobic property by heating. A non-processing printing plate precursor for offset printing is produced by applying these two characteristics to the discrimination of ink-receptivity from ink repellency, and used printing plate precursors are reclaimed for recycling also by utilizing the above heat conversion characteristics of the surface physical properties.

As described above, the foregoing fundamental techniques are disclosed in JP-A-11-78272.

The improved point of the present invention based on the above fundamental technique is that the surface of the thin layer on the substrate is a scabrous surface comprising concavities and convexities having an arithmetic mean pore diameter calculated in terms of a circle of the concavities of at least 1.0 $\mu$m.

The cardinal point of the present invention is to exclude minute structure of surface unevenness as has been made clear that the remaining ink is insistently adhered onto the minute part of surface uneven structure of a printing plate and does not dissolve in a detergent when a used printing plate precursor is washed with an ink detergent. Surface roughness is necessary for increasing the retaining property of a fountain solution of the ink-repellent part on a printing plate during printing, but it is not necessary to be especially minute and it should be sufficient that concavity and convexity have a large period in some degree.

Degree of minuteness of uneven structure can be expressed by a mean pore diameter calculated in terms of a circle by taking the arithmetic mean value of the diameter of one concavity (referred to as "equivalent circle pore diameter") regarding the concavity as a circular concavity. The object of the present invention has been attained by employing a printing plate precursor in which the surface of the thin layer has mean equivalent circle pore diameter of at least 1 $\mu$m. Degree of minuteness of the unevenness of a printing plate is adjusted by adjusting the unevenness of the surface of the printing plate substrate. As the thin layer is exceedingly thin, the unevenness of a substrate is directly reflected.

KEY TO THE SYMBOLS

Figure 1:
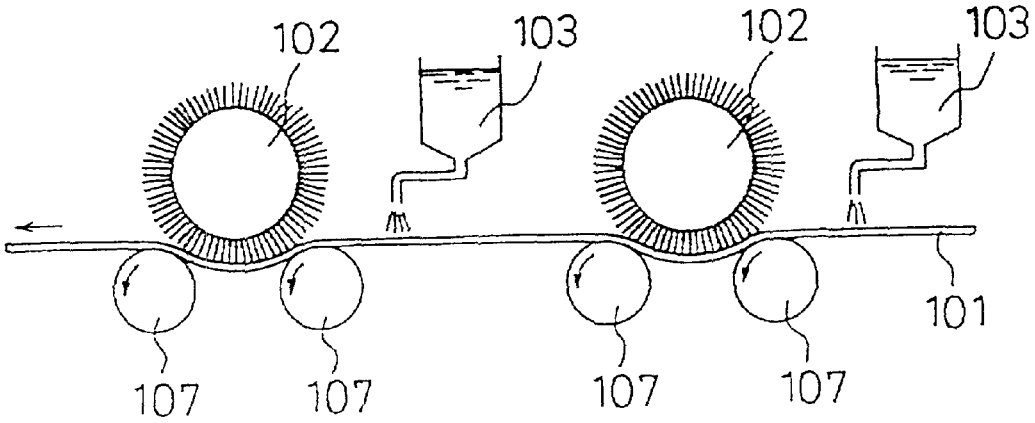
FIG. 1 is a schematic view showing one example of mechanical graining processing step using a brush.

101: Plate to be processed.
102: Brush roll
103: Abrasive slurry
107: Supporting roller
201: Nip roll
202: Passing roll
204: Solution-feeding pump
205: Solution-preparing tank
206: Diffusion tank
207: Precipitation sank
211: Etching processing tank
212: Pipeline for feeding
213: Pipeline for returning solution
222: Aluminum plate
301: Aluminum support
302, 303: Front surface-graining apparatus
304: Back surface-graining apparatus
305: Electrolytic cell
306: Main electrode
307: Drum roll
308: Electrolyte
309: Passing roll
310: Reverse path
311: Sprayer

DETAILED DESCRIPTION OF THE INVENTION

The present invention will be described in detail below. In the first place, the terminology used in the present invention will be described. The above-described "a substance which converts light energy to heat energy" is called "a light/heat convertible substance", and "a layer containing a light/heat convertible substance" is called "a light/heat convertible layer". Radiant rays which are absorbed by this substance is called "light/heat convertible radiant rays". A light/heat convertible substance will be described in detail later.

If the substance constituting the thin layer absorbs light and the substance is excited to thereby convert the surface of the thin layer to hydrophilic, that light is "active light". The details as to the light source and wavelength are described in detail later. Of the substances constituting the photosensitive thin layer which are excited by the absorption of active light and convert the irradiation range to hydrophilic, particularly superior substances are the above-defined specific metallic oxides, and these substances are called "photocatalytic metallic oxides" from their photochemical characteristics. Further, "imagewise exposure" is exposure to imagewise distribute the intensity of illumination of light-received face. "Thin film" is used in the same meaning as "thin layer".

Substrate

A variety of printing plate forms and substrate materials can be applied to the printing plate according to the present invention. For example, a method of providing a light/heat convertible layer and an oxide layer of a photocatalytic metallic oxide directly on the surface of a plate cylinder of a printer by the above-described method such as vacuum depositing, immersing or coating; and a method of making a printing plate by providing a light/heat convertible layer and a layer of photocatalytic metallic oxide on the surface of a metal plate and winding the metal plate around a plate cylinder can be used, and an aluminum plate, stainless steel, nickel, or a copper plate can be preferably used as such a metal plate, and flexible metal plates can also be used. Flexible plastic supports, e.g., polyesters or cellulose esters can also be used. In addition, a light/heat convertible layer and a photocatalytic metallic oxide layer may be provided on a substrate, such as waterproofing paper, polyethylene laminated paper, or impregnated paper, and these may be used as a printing plate.

Substrates which can be used in the present invention are plate-like materials having dimensional stability, and examples of substrates include paper, paper laminated with plastics (e.g., polyethylene, polypropylene, polystyrene), a metal plate (e.g., aluminum, zinc, copper, stainless steel), a plastic film (e.g., cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinyl acetal), and paper or a plastic film laminated or deposited with the above metals.

Preferred substrates are a polyester film, aluminum, stainless steel not liable to be corrosive on a printing plate such as SUS plates, nickel, and copper. Flexible metal plates can also be used. Of these materials, an aluminum plate is particularly preferred because it is dimensionally stable and relatively inexpensive. Preferred aluminum plates are a pure aluminum plate and an aluminum alloy plate comprising aluminum as a main component and a trace amount of foreign elements. A plastic film laminated or deposited with aluminum may also be used. Foreign elements which may be contained in aluminum alloy include silicon, iron, manganese, copper, magnesium, chromium, zinc, bismuth, nickel, titanium, etc. The content of foreign elements in the aluminum alloy is 10% by weight or less. Particularly preferred aluminum for use in the present invention are pure aluminum but 100% pure aluminum is difficult to produce from the refining technique, accordingly an extremely small amount of foreign elements may be contained. The composition of aluminum plates used in the present invention are not specified as described above, and conventionally well-known and commonly used aluminum materials can be used arbitrarily. A substrate for use in the present invention has a thickness of from about 0.05 to about 0.6 mm, and preferably from 0.1 to 0.4 mm.

An aluminum plate and a copper plate are especially preferably used as a substrate in the present invention. The method of graining of an aluminum plate is described below, but substrates other than an aluminum plate can also reduce ink stain when a printing plate precursor is repeatedly used so long as the degree of graining is within the prescription of the present invention.

Prior to graining of an aluminum plate, if desired, degreasing treatment for removing the rolling oil on the surface of the plate is conducted using a surfactant, an organic solvent or an alkaline aqueous solution, for example.

Graining treatment of an aluminum plate can be performed by various methods, e.g., mechanical graining, electrochemical graining by dissolving the surface, and chemical graining by selectively dissolving the surface. As mechanical graining, well-known methods, e.g., a ball rubbing method, a brush abrading method, a blasting method, or a buffing method, can be used. As electrochemical graining, a method of graining the surface in a hydrochloric acid or nitric acid electrolyte by alternating current or direct current can be used. Further, both methods can be used in combination as disclosed in JP-A-54-63902.

The thus surface-roughened aluminum plate is, if required, subjected to alkali etching treatment and neutralizing treatment and then to anodizing treatment to obtain desired water retentivity and abrasion resistance of the surface. Various electrolytes for forming porous oxide film can be used in the anodizing treatment of an aluminum plate and, in general, sulfuric acid, hydrochloric acid, oxalic acid, chromic acid and mixed acids of these are used. The concentration of these electrolytes are arbitrarily determined according to the kinds of electrolytes.

For heightening the discriminating property of an ink-receiving area from an ink-repellent area of a printing plate substrate, the surface of a substrate is subjected to graining to increase the retentivity of a fountain solution in an ink-repellent area. Graining is a combination of a concavity and a convexity having a large period, i.e., the distance between a concavity and a convexity is long, a concavity and a convexity having a medium distance, and a small period concavity and convexity adjacent with an extremely short distance, and such a combination contributes to increase the retentivity of a fountain solution stably. An aluminum substrate for a generally used PS plate comprises minute concavities and convexities having a mean equivalent circle diameter of from 0.05 to 0.5 $\mu$m all over the surface and the above-described concavity and convexity of a large period (sometimes referred to as "high wave") and a medium period (sometimes referred to as "medium wave") are overlapped with them. In the present invention, however, for preventing the ink stain of the printing plate precursor during repeating use, minute concavity and convexity, i.e., small period concavity and convexity, are not provided on an aluminum substrate, and concavities and convexities are restricted to those having a mean equivalent circle diameter of from 1.0 to 30.0 $\mu$m, i.e., from a medium period to a long period.

Concavities and convexities of from a medium period to a long period can be provided on a substrate by means of well-known methods. For example, long period concavities and convexities can be formed by mechanical graining described later and medium period concavities and convexities can be formed by electrolytic graining also described later.

An aluminum plate is subjected to surface treatments as follows.

Pre-treatment is conducted to remove a rolling oil from an aluminum plate surface with a solvent such as trichlene and a surfactant, and to expose a clean aluminum plate surface with an alkali etching agent such as sodium hydroxide and potassium hydroxide.

Specific methods of degreasing with a solvent include a method using a petroleum solvent such as gasoline, kerosene, benzene, solvent naphtha, or normal hexane, and a method using a chlorine solvent such as trichloroethylene, methylene chloride, perchloroethylene, or 1,1,1-trichloroethane. Alkali decreasing methods include a method using an aqueous sodium salt solution such as sodium hydroxide, sodium carbonate, sodium bicarbonate, or sodium sulfate, a method using an aqueous silicate solution such as sodium orthosilicate, sodium metasilicate, sodium disilicate, or sodium tetrasilicate, and a method using an aqueous phosphate solution such as sodium primary phosphate, sodium tertiary phosphate, sodium secondary phosphate, sodium tripolyphosphate, sodium pyrophosphate, or sodium hexametaphosphate. When an alkali degreasing method is used, there is possibility that the surface of aluminum may be dissolved according to processing time and processing temperature, hence degreasing treatment should be performed so as not to be accompanied by a dissolution phenomenon. An aqueous solution of anionic surfactant, cationic surfactant, nonionic surfactant or ampholytic surfactant is used in decreasing treatment by a surfactant. Various commercially available products can be used. An immersing method, a spraying method, and a rubbing method using cloth impregnated with a solution can be used in a degreasing method. Ultrasonic waves may be employed in an immersing method and a spraying method.

With respect to the above degreasing methods, JP-A-2-26793 can be referred to, for example.

It is preferred to perform mechanical graining treatment in the next place. Mechanical graining is performed for forming concavities and convexities of large period, and there are methods of transferring, brushing and liquid honing. These methods may be employed in combination from the viewpoint of productivity.

As a transferring method for pressing concave and convex face on an aluminum plate, various methods can be used, e.g., in addition to the above-described JP-A-55-74898, JP-A-60-36195 and JP-A-60-203496, the technique of performing transferring a couple of times as disclosed in Japanese Patent Application No. 4-175945, and the elastic surface as disclosed in JP-A-6-24168 are also applicable to the present invention.

Further, transferring may be carried out repeatedly using a transferring roll engraved with minute concavities and convexities by means of electric discharge machining, shot blasting, laser beams or plasma etching, or transferring may be carried out repeatedly by bringing the face of a roll coated with fine particles to make the face uneven into contact with an aluminum plate and applying pressure on the roll several times, to thereby transfer the concave/convex pattern corresponding to the average diameter of fine particles to the aluminum plate.

Methods of giving minute concavities and convexities to a transferring roll are well-known and disclosed, e.g., in JP-A-3-8635, JP-A-3-66404 and JP-A-63-65017. Also, square concavities and convexities may be provided on the surface of a roll by grooving finely from two directions by dies, bites or laser beams. Further, the surface of the roll may be treated by well-known etching treatment and the like to make the formed square concavities and convexities round. The surface of the roll may of course be subjected to quenching or hard chrome plating to increase hardness.

FIG. 1 is a schematic view showing one example of mechanical graining processing step using a brush. Aluminum plate to be processed 101 is traveled in the arrow direction with being supported by supporting roller 107, abrasive slurry 103 is sprayed uniformly on the surface of plate to be processed 101, and brush roll 102 is rotated on the surface of 101, thereby mechanical graining treatment is performed. In this example, spraying of abrasive slurry and graining treatment by a brush roll is performed at two places.

When a brush is used, the brush preferably has bending elastic modulus of from 10,000 to 40,000 kg/cm$^2$, and preferably from 15,000 to 35,000 kg/cm$^2$, and stiffness (i.e., nerve) of the brush hair is 500 g or less, preferably 400 g or less. It is also preferred to use abrasives having a particle size of from 20 to 80 $\mu$m, and preferably from 30 to 60 $\mu$m.

Materials for the brush are preferably those having the above mechanical strengths, but materials having mechanical strengths out of the above ranges can also be used, e.g., synthetic resins and metals can be arbitrarily selected. As synthetic resins, polyamides, e.g., nylon, polyolefins, e.g., polypropylene, polyesters, e.g., polyvinyl chloride and polybutylene terephthalate, and polycarbonate can be exemplified, and examples of metals include stainless steel and brass.

Particle sizes of the materials of the abrasive are also preferably within the above range but the materials are not particularly limited, and can be selected from among alumina, silica, silicon carbide, and silicon nitride which have been conventionally used in mechanical graining treatment.

Mechanical graining treatment is performed by pressing the roll brush having the above-described brush hair against an aluminum plate surface while rotating at high speed with supplying the above-described abrasive to the roll brush. The rotary rate and pressing force of the roll brush and the feeding rate of the abrasive at this time are not particularly restricted.

The apparatus disclosed in JP-B-50-40047 (the term "JP-B" as used herein means an "examined Japanese patent publication") can be suitably used in the above mechanical graining treatment.

After mechanical graining treatment, the surface of the aluminum plate is subjected to chemical etching with an alkali solution having a pH value of 11 or more, preferably 13 or more with a view to smoothing and uniforming the aluminum plate.

Figure 2:
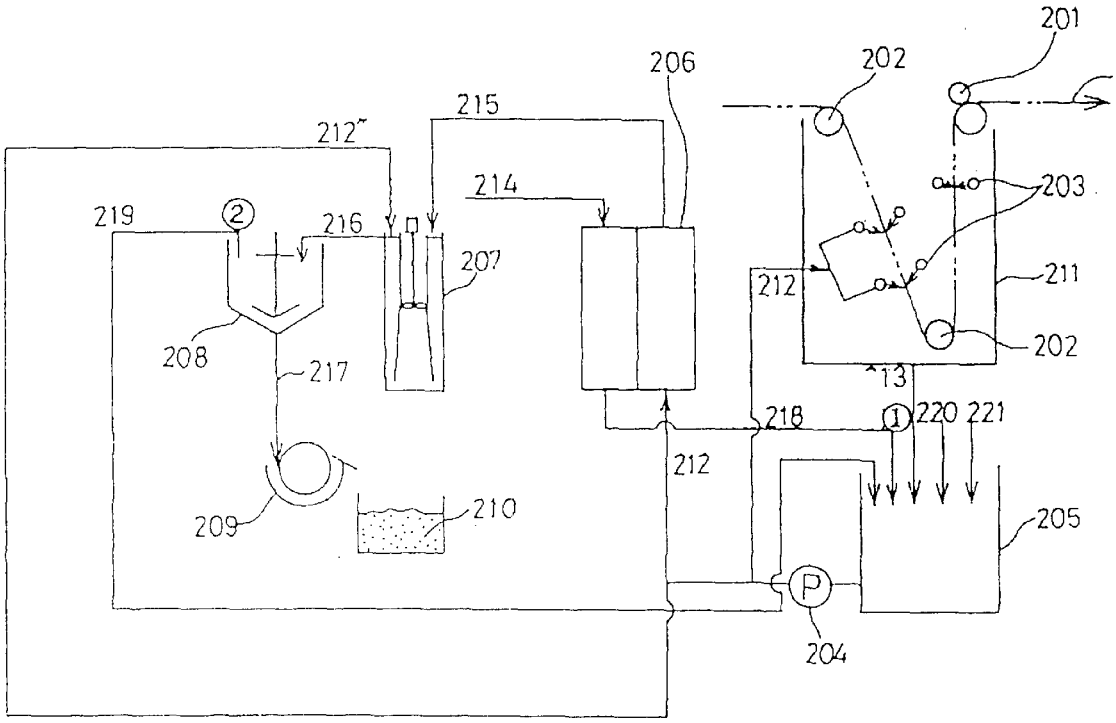
FIG. 2 is a schematic view showing one example of chemical etching processing step of an aluminum surface.

FIG. 2 is a schematic view showing one example of chemical etching processing step of an aluminum surface. Aluminum plate 222 is guided through etching processing tank 211 by means of passing roll 202 and nip roll 201. In etching processing tank 211, an alkali solution in solution-preparing tank 205 is fed through pipeline for feeding 212 by solution-feeding pump 204 (P) and the processing solution (an etching solution comprising mainly sodium hydroxide) is sprayed by spray 203 in the width direction of aluminum plate 222 uniformly all over the direction, thereby aluminum plate 222 undergoes surface etching.

A processing solution is prepared in solution-preparing tank 205 and the prepared processing solution is fed to spray 203 through pipeline for feeding 212 by means of solution-feeding pump 204. The processing solution from solution-preparing tank 205 can further be fed to diffusion tank 206 or precipitation tank 207 through pipelines for feeding 212' and 212" branched from pipeline for feeding 212 by means of solution-feeding pump 204. The feeding amount and time can be controlled by the operation of valves provided within the pipeline (not shown in the figure)

Solution-preparing tank and the etching processing tank are linked via pipeline for feeding 212 and pipeline for returning solution 213 and the processing solution circulates through these. Supplying of a sodium hydroxide solution and water to the processing solution in the solution-preparing tank is performed through pipelines 200 and 201 for replenishment respectively. In diffusion dialysis tank 206, about 70% of the fed processing solution is recovered as a sodium hydroxide solution, the waste solution dialyzed in the diffusion dialysis tank becomes supersaturated sodium aluminate solution, and the dialyzed waste solution is introduced to precipitation tank 207 through pipeline for dialyzed waste solution 215, where aluminum ions are excluded from the system, thus the concentration and composition of the etching solution is controlled. Water can be added to the diffusion dialysis tank for replenishing for the evaporated water via pipeline for feeding 214.

The etching amount in chemical etching treatment is from 3 g/m$^2$ to 25 g/m$^2$, preferably from 3 g/m$^2$ to 15 g/m$^2$. When the etching amount is less than 5 g/m$^2$, concavities and convexities formed by mechanical graining treatment cannot be smoothed and uniform pits cannot be formed in the later electrolytic treatment. On the other hand, if the etching amount exceeds 25 g/m$^2$, the foregoing concavities and convexities are vanished.

As usable alkali solutions in the present invention, an aqueous sodium salt solution such as sodium hydroxide, sodium carbonate, sodium bicarbonate, or sodium sulfate, an aqueous silicate solution such as sodium orthosilicate, sodium metasilicate, sodium disilicate, or sodium tetrasilicate, and an aqueous phosphate solution such as sodium primary phosphate, sodium secondary phosphate, sodium tertiary phosphate, sodium tripolyphosphate, sodium pyrophosphate, or sodium hexametaphosphate can be exemplified.

As conditions of chemical etching, the concentration of an alkali solution is from 0.01 to 50% by weight, the temperature is from 20 to 90° C., and the time is from 5 seconds to 5 minutes, and they are arbitrarily selected so that the etching amount falls within the above range.

As a result of chemical etching of an aluminum plate surface using the above alkali solution, insoluble residue, i.e., smut, is formed on the surface of the plate, which is removed with an acid solution having the same composition as the acid solution which is used in the later electrolytic graining treatment.

Preferred treatment conditions are the temperature of from 30 to 80° C. and the time of from 3 seconds to 3 minutes.

The thus-treated aluminum plate is subjected to electrolytic graining treatment. In the electrolytic graining treatment according to the present invention, it is preferred to perform the first and second electrolytic treatments in an acid solution by alternating wave electric current before and after cathode electrolytic treatment. Smut is formed on the surface of the aluminum plate due to cathode electrolytic treatment and, at the same time, hydrogen gas is generated, thus more uniform electrolytic graining becomes possible.

In the first place, the first and second electrolytic graining treatments in an acid solution by alternating wave electric current is described. The first treatment and the second treatment may be performed on the same condition or may be different from each other within the preferred range of conditions.

Figure 3:
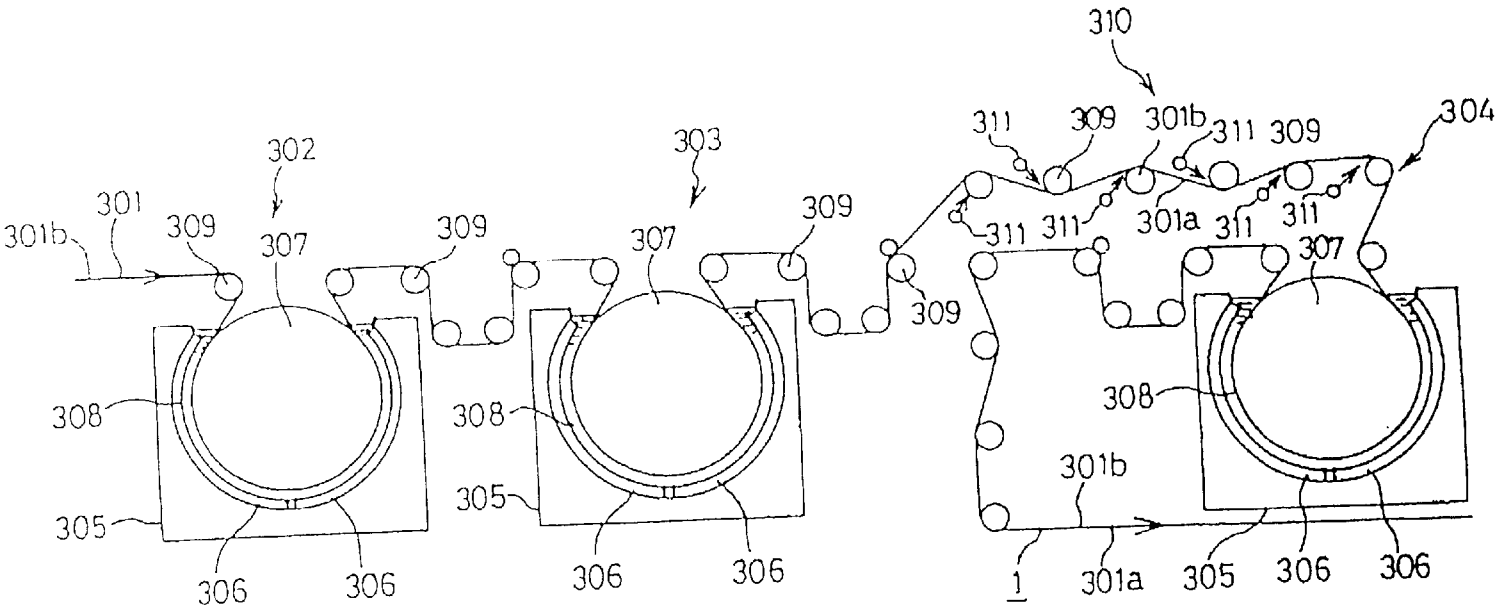
FIG. 3 is a schematic view showing one example of treatment step of an aluminum support including a first and second electrolytic graining treatments.

FIG. 3 is a schematic view showing one example of treatment step of an aluminum support including a first and second electrolytic graining treatments.

In FIG. 3, symbol 301 is an aluminum support, 301*a* is a front surface (the surface to be subjected to electrolytic graining treatment first), and 301*b* is a back surface (the surface to be subjected to electrolytic graining treatment later).

Symbol 302 is first front surface-graining apparatus for electrolytically graining front surface 301*a* of aluminum support 301, symbol 303 is second front surface-graining apparatus for electrolytically graining front surface 301*a* of aluminum support 301, and symbol 304 is back surface-graining apparatus for electrolytically graining back surface 301*b* of aluminum support 301. These front surface-graining apparatus 302, 303 and back surface-graining apparatus 304 are provided with a pair of main electrodes 306, 306, respectively, of a circular arc connected to electrolytic cell 305 via AC power (not shown), and rotatable drum roll 307 is arranged above main electrode 306. Electrolyte 308 is filled between main electrode 306 and drum roll 307.

Among first front surface-graining apparatus 302, second front surface-graining apparatus 303 and back surface-graining apparatus 304, a plurality of passing rolls 309 are arranged at prescribed positions, to thereby form a path of aluminum support 301. The path between second front surface-graining apparatus 303 and back surface-graining apparatus 304 makes, in back surface-graining apparatus 304, reverse path 310 to reverse aluminum support 301 so that front surface 301*a* comes to be contact with drum roll 307 and back surface 301*b* is immersed in electrolyte 308. A plurality of sprayers 311 are provided in reverse path 310 for spraying electrolyte to aluminum support 301.

For producing an aluminum support by the above-described apparatus, aluminum support 301 is traveled with the application of electric power to each main electrode 306 of each graining apparatuses 302, 303 and 304. As a result, front surface 301*a* of aluminum support 301 is continuously grained in first front surface-graining apparatus 302 and second front surface-graining apparatus 303. Aluminum support 301 whose front surface 301*a* has undergone graining treatment passes through reverse path 310, and sent to back surface-graining apparatus 304 in a reversed state so that front surface 301*a* comes to be contact with drum roll 307 of back surface-graining apparatus 304 and back surface 301*b* is immersed in electrolyte 308. Aluminum support 301 is always maintained in a wet state by being sprayed with electrolyte from a plurality of sprayers 311 during traveling through reverse path 310.

This electrolytic graining treatment can follow electrochemical grain method as disclosed, e.g., in JP-B-48-28123 and British Patent 896,563. This electrolytic graining treatment uses sine wave alternating current but specific wave forms such as those disclosed in JP-A-52-58602 may be used. Wave forms as disclosed in JP-A-3-79799 can also be used.

Various methods such as those disclosed in JP-A-55-158298, JP-A-56-28898, JP-A-52-58602, JP-A-52-152302, JP-A-54-85802, JP-A-60-190362, JP-A-58-120531, JP-A-63-176178, JP-A-3-260100, JP-A-3-253600, JP-A-4-72079, JP-A-4-72098, JP-A-3-267400, and JP-A-1-141094 can also be referred to.

Frequencies suggested in electrolytic condenser can also be used in addition to the above, e.g., those disclosed in U.S. Pat. Nos. 4,276,129 and 4,676,879.

As the acid solution which is an electrolyte, those disclosed in U.S. Pat. Nos. 4,671,859, 4,661,219, 4,618,405, and 4,600,482 can be used as well as nitric acid and hydrochloric acid.

The concentration of an acid solution is preferably from 0.5 to 2.5% by weight but from 0.7 to 2.0% by weight is especially preferred taking into consideration the use in the above smut removal. The temperature of the solution is preferably from 20 to 80° C. and particularly preferably from 30 to 60° C.

Various electrolytic cells and electric powers are suggested, e.g , those disclosed in the following patents: U.S. Pat. No. 4,203,637, JP-A-56-123400, JP-A-57-59770, JP-A-53-12738, JP-A-53-32821, JP-A-53-32822, JP-A-53-32323, JP-A-l-230800, and JP-A-3-257199.

In addition to the above, e.g., those disclosed in the following patents are also applicable to the present invention: JP-A-52-58602, JP-A-52-152302, JP-A-53-12739, JP-A-53-32833, JP-A-52-133845, JP-A-53-149135, and JP-A-54-146234.

The electrolytic treatment is carried out with the quantity of the anode electricity of from 30 to 400 C/dm$^2$, preferably from 80 to 300 C/dm$^2$. If the quantity of the anode electricity is less than 30 C/dm$^2$, uniform pits cannot be formed and the equivalent circle pore diameter of a circle becomes extremely minute. On the other hand, if it exceeds 400 C/dm$^2$, the equivalent circle pore diameter becomes too large.

The aluminum plate undergoes cathode electrolytic treatment during the above first and second electrolytic graining treatments. Smut is formed on the surface of the aluminum plate due to the cathode electrolytic treatment and, at the same time, hydrogen gas is generated, thus more uniform electrolytic graining becomes possible.

The cathode electrolytic treatment is carried out in an acid solution with the quantity of the cathode electricity of from 3 to 80 C/dm$^2$, preferably from 5 to 30 C/dm$^2$. If the quantity of the cathode electricity is less than 3 C/dm$^2$, the smut adhesion amount is insufficient, while if it exceeds 80 C/dm$^2$, smut excessively adheres, which is disadvantageous.

The electrolyte used at this time may be the same as or different from that used in the first and second electrolytic graining treatments.

After the second electrolytic graining treatment, the aluminum plate is subjected to the second chemical etching treatment using an alkali solution having pH of 11 or higher. The alkali solution having pH of 11 or higher used in the second chemical etching treatment may be the same as or different from the alkali solution used in the above-described first chemical etching treatment.

However, the etching amount is different from that in the first chemical etching treatment, and is generally from 0.1 to 8 g/m$^2$, preferably from 0.2 to 3.0 g/m$^2$, and still more preferably from 0.5 to 1.5 g/m$^2$. If the etching amount is less than 0.1 g/m$^2$, the edge of the pit obtained by the electrolytic treatment cannot be smoothed, while if it exceeds 8 g/m$^2$, pits are vanished.

As smut is generated by the above chemical etching treatment, the smut is removed from the aluminum plate with a solution mainly comprising a sulfuric acid. "A solution mainly comprising a sulfuric acid" means a mixed solution containing a phosphoric acid, a nitric acid, a chromic acid or a hydrochloric acid appropriately, as well as a solution comprising a sulfuric acid alone. As for the smut removal using a solution mainly comprising a sulfuric acid, JP-A-53-12739 can be referred to.

Alkali treatment may be combined with the removal of smut and JP-A-56-51388 can be referred to, for example.

The methods disclosed in the following patents may also be used together, e.g., JP-A-60-8091, JP-A-63-176188, JP-A-1-38291, JP-A-1-127389, JP-A-1-188699, JP-A-3-177600, JP-A-3-126891 and JP-A-3-191100.

It is preferred to form anodic oxide film on the surface of the aluminum plate. Anodizing treatment may be performed according to well-known methods.

Anodization is performed, for example, by using an electrolyte containing a sulfuric acid in concentration of from 50 to 300 g/liter and having aluminum concentration of 5% by weight or less, and applying an electric current to the aluminum plate as the anode, to thereby form an anodic oxide film. A phosphoric acid, a chromic acid, an oxalic acid, a sulfamic acid or a benzenesulfonic acid may be compounded to the foregoing solution.

It is preferred that the amount of the anodic oxide film to be formed is from 1.0 to 5.0 g/m$^2$, particularly preferably from 1.5 to 4.0 g/m$^2$.

If the amount of the anodic oxide film is less than 1.0 g/m$^2$, the obtained printing plate has insufficient press life, or the non-image area of a lithographic printing plate is liable to be damaged, which results in "scratching stain" due to the adhesion of ink at the scratched part.

The treatment conditions of anodization variously change according to the electrolyte to be used hence cannot be mentioned unconditionally but in general the concentration of an electrolyte is from 1 to 80% by weight, the temperature of the solution is from 5 to 70° C., the electric current density is from 0.5 to 60 A/cm$^2$, the voltage is from 1 to 100 V, and the period of time of electrolysis is from 15 seconds to 50 minutes, and conditions are adjusted so as to obtain the above film amount.

Examples of electrolytic apparatus are disclosed, e.g., in JP-A-48-26638, JP-A-47-18739 and JP-B-58-24517. The methods disclosed in JP-A-54-8113, JP-A-57-47894, JP-A-6-207299, JP-A-5-24377, JP-A-5-32083, JP-A-5-125597 and JP-A-5-195291 can also applied to the present invention.

The methods of graining of the substrate according to the present invention have been described above. Subsequently, the method of measuring the degree of graining (roughness) of a substrate surface will be described below. AFM (Atomic Force Microscope) is used in the measurement of the degree of graining, e.g., Model SP13700 (manufactured by Seiko Electronic Industries Co., Ltd.) . An aluminum plate sample cut to a size of 1 cm square is set on a horizontal sample table on a piezo-scanner, a cantilever is approached to the surface of the sample, and when the cantilever reaches the region where the interatomic power works, the sample is scanned in the X and Y directions. At that time, concavities and convexities of the sample are caught by the displacement of the piezo-scanner in the Z direction. Piezo-scanners having the resolution in X/Y direction: 150 μm and Z direction: 10 μm can be used. The cantilever used is SI-DF20 (manufactured by NANOPROBE Co.) having resonance frequency of 120–50 KHz, spring constant of 12–20 N/m, and measurement is conducted in DFM mode (Dynamic Force Mode). Datum level can be obtained by compensating for a trace of gradient of the sample by the least square approximation of the obtained three dimensional data.

Although the degree of graining (roughness: fineness) of medium wave is important in the present invention, high wave is also overlapped, accordingly the measuring method of high wave is described in the first place. In the measurement of undulation, average surface roughness and the degree of gradient of high wave, measured area was four-fields of 120 μm square, i.e., 240 μm square. Resolution in X/Y direction was 1.9 μm, Z direction was 1 nm, and scanning speed was 60 μm/sec. The pitch of the undulation of high wave can be calculated by the frequency analysis of three dimensional data.

In the measurement of the pit diameter of medium wave, measured area was four-fields of 25 μm square, i.e., 50 μm square, resolution in X/Y direction was 0.1 μm, Z direction was 1 nm, and scanning speed was 25 μm/sec. The pit diameter can be obtained from the edge length of the pit.

As the undulation of the aluminum plate as a substrate, graining comprising high waves having an average pitch of from 5 to 30 μm overlapping with graining of from 1.0 to 5 μm is preferred, and it is particularly preferred that graining of from 1 to 2 μm are formed uniformly all over the surface, and pit density is from $1\times10^5$ to $1\times10^7$ pieces m$^2$. When opening diameter is taken as axis of abscissa and cumulative frequency (%) as axis of ordinate, the opening diameters corresponding to 5% and 95% of the cumulative frequency curve are preferably 0.7 μm or more and 20 μm or less respectively, and more preferably 0.8 μm or more and 15 μm or less. Also, the opening diameters corresponding to 10% and 90% of the cumulative frequency curve are preferably 0.9 μm or more and 10 μm or less respectively. Further, the arithmetic mean equivalent circle pore diameter is preferably from 1.0 to 3 μm.

Thin Layer

Substances which can be used in the thin layer according to the present invention described above are substances which absorb active light and convert the surface of the thin layer to hydrophilic and can form a thin layer. Examples of such substances include zirconia ceramic (disclosed in JP-A-9-169098), dispersions of silicon oxide/titanium oxide doped with silver, copper and zinc (disclosed in JP-A-9-60443), and sol dispersions of titanium hydroxide.

Particularly preferred substances for the thin layer are photocatalytic metallic oxides described in the above item. Accordingly, the photocatalytic metallic oxides described above for use in the present invention are described below.

Titanium oxide produced by well-known methods, e.g., sulfuric acid heating calcination or oxygen-oxidation after heat chlorination of ilmenite and titanium slug, can be used in the present invention. Alternatively, as described later, an oxide film may be formed by vacuum deposition using metal titanium during the printing plate producing stage.

Any crystal type titanium oxide can be used in the present invention, in particular, anatase type crystals are particularly preferred for obtaining high sensitivity. It is well known that anatase type crystals can be obtained by selecting the calcination conditions to obtain titanium oxide by calcination. In that case, amorphous titanium oxide or rutile type titanium oxide may be contained but those comprising 40% or more of anatase type, preferably 60% or more, are preferred from the above reason.

R of titanate represented by $RTiO_3$ is a metal atom belonging to alkaline earth elements of the Periodic Table, such as magnesium, calcium, strontium, barium, and beryllium, and strontium and barium are particularly preferred. Two or more kinds of alkaline earth metal atoms may coexist as the above R so long as the total of R stoichiometrically coordinate with the formula.

In formula represented by $AB_{2-x}C_xD_{3-x}E_xO_{10}$, A represents a hydrogen atom or a monovalent atom selected from an alkali metal atom, such as sodium, potassium, rubidium, cesium, and lithium, and two or more kinds of alkali metal atoms may coexist as A so long as the total of A stoichiometrically coordinate with the formula.

B represents the same alkaline earth metal atom with the above R or a lead atom, and two or more atoms may coexist so long as the total of B stoichiometrically coordinate with the formula.

C represents a rare earth atom, preferably represents, in addition to scandium and yttrium, an atom belonging to lanthanoid series elements, such as lanthanum, cerium, praseodymium, neodymium, holmium, europium, gadolinium, terbium, thulium, ytterbium, or lutetium, and similarly two or more atoms may coexist so long as the total of C stoichiometrically coordinate with the formula.

D represents one or more metal atoms belonging to elements of Group V-A of the Periodic Table, such as nitrogen, phosphorus, arsenic, antimony, or bismuth, and similarly two or more atoms may coexist so long as the total of D stoichiometrically coordinate with the formula.

E represents a metal atom belonging to elements of Group IV of the Periodic Table, such as titanium, silicon, germanium, tin, or lead, and two or more atoms may coexist.

x represents an arbitrary numerical value of from 0 to 2.

Specific examples of compounds represented by formula $AB_{2-x}C_xD_{3-x}E_xO_{10}$ include $CsLa_2NbTi_2O_{10}$, $CsMgLaNbTi_2O_{10}$, $RbMgLaNbTi_2O_{10}$, $HCa_{1.5}La_{0.5}Nb_{2.5}Ti_{0.5}O_{10}$, and $HCaLaNbTi_2O_{10}$.

In the present invention, a thin layer comprising at least one compound alone or combination of two or more of the above $TiO_2$, $RTiO_3$, $AB_{2-x}C_xD_{3-x}E_xO_{10}$, $SnO_2$, ZnO, $Bi_2O_3$, and $Fe_2O_3$ is provided on the surface of the printing plate precursor as a photosensitive layer.

There are various well-known methods for forming a thin layer of the above-described photocatalytic metallic oxides according to the present invention on the surface of a printing plate precursor or on a layer containing a light/heat convertible substance (a light/heat convertible layer) on a substrate, for example, (1) a method of coating the dispersion of fine particles of these metallic oxides on a printing plate precursor or on a light/heat convertible layer on a printing plate precursor, (2) a method of reducing or removing the binder by calcination after the layer has been formed, (3) a method of forming a thin layer of the above metallic oxides by various vacuum thin film-forming methods on a printing plate precursor or on a light/heat convertible layer on the precursor, (4) a method of coating organic compounds such as alcoholates of metal elements on a printing plate precursor or on a light/heat convertible layer on the precursor, hydrolyzing and then oxidizing the coated layer by calcination, to thereby form a metal film having a proper thickness, (5) a method of spraying with heating an aqueous solution of hydrochloride or nitrate containing the above metal, and (6) a method of electrolytically oxidizing the surface of the former metal of the oxide, and these methods can be arbitrarily selected in the present invention. A titanium oxide layer formed by vacuum deposition is preferably used in the present invention.

The above method (1) or (2) of coating titanium oxide crystallite specifically includes a method of coating an amorphous titanium oxide crystallite dispersion, and then calcining the coated film to thereby form an anatase or rutile type crystal titanium oxide layer, a method of coating a mixed dispersion of titanium oxide and silicon oxide to form a surface layer, and a method of coating a mixture of titanium oxide and organopolysiloxane or a monomer thereof.

The above method (1) or (2) of coating barium titanate fine particles includes a method of coating a mixed dispersion of barium titanate and silicon to form a surface layer, and a method of coating a mixture of barium titanate and organopolysiloxane or a monomer thereof.

These metallic oxides may be coated by being dispersed in a polymer binder capable of coexisting with oxides to form a thin layer. As a binder for oxide fine particles, polymer shaving dispersibility to barium titanate fine particles are widely used. Examples of preferred binder polymers include a hydrophobic binder such as a polyalkylene polymer, e.g., polyethylene, polybutadiene, polyacrylate, polymethacrylate, polyvinyl acetate, polyvinyl formate, polyethylene terephthalate, polyethylene naphthalate, polyvinyl alcohol, partially saponified polyvinyl alcohol and polystyrene. These resins may be used in combination.

In this method, in addition to titanium oxide and barium titanate, magnesium titanate, calcium titanate, strontium titanate, and intermolecular compounds and mixtures of these can also be used for forming a thin layer.

In coating methods (1) and (2), it is also possible to coat fine particles of $CsLa_2NbTi_2O_{10}$. $Cs_2CO_3$, $La_2O_3$, $NbO_5$ and $TiO_2$, which are stoichiometrically corresponding to $CsLa_2NbTi_2O_{10}$, are finely pulverized in a mortar, the content is put in a platinum crucible and calcined at 130° C. for 5 hours, then cooled and put again in the mortar and pulverized to fine particles of a particle size of several micrometers or less. The obtained fine particles of $CsLa_2NbTi_2O_{10}$ are dispersed in a binder in the same manner as the above barium titanate, and then coated on a printing plate precursor or on a light/heat convertible layer on the precursor, thus a thin film is formed. This method is not limited to fine particles of $CsLa_2NbTi_2O_{10}$ and also applied to $HCa_{1.5}La_{0.5}Nb_{2.5}Ti_{0.5}O_{10}$ and $Cs_2MgLaNbTi_2O_{10}$ represented by formula $AB_{2-x}C_xD_{3-x}E_xO_{10}$ ($0 \leqq x \leqq 2$).

As the above method (3) of forming a thin layer of a photocatalytic metallic oxide by a vacuum thin film-forming method, a sputtering or vacuum thin film-forming method is generally used. In a sputtering method, a simple substance or binary oxide target is previously prepared. For instance, a barium titanate crystalline thin film can be obtained by performing RF sputtering using a barium titanate target in the argon/oxygen mixed atmosphere with maintaining the temperature of the substrate for a deposit film 450° C. or higher. For controlling the crystallinity, post-annealing may be performed at 300 to 900° C. according to necessity. In addition to the above titanium oxide and $RTiO_3$ (wherein R represents an alkaline earth metal atom) this method can be applied to other photocatalytic metallic oxides and similar thin films can be formed by adjusting the temperature of the substrate optimally for crystal control.

For example, in the formation of a thin film of tin oxide, the thin film of tin oxide which meets the object of the present invention can be obtained by RF sputtering with a sputtering power of 200 W in the argon/oxygen (50/50 by mol) mixed atmosphere at a substrate temperature of 120° C.

Further, when a vacuum deposition of titanium oxide is performed, in general, metal titanium is placed at heat source for vapor-deposition in a vacuum deposition apparatus, and by evaporating the titanium metal in a manner so as to make the degree of vacuum exp (−5 to −8) Torr, the full gas pressure exp (−2 to −5), and the oxygen partial pressure ratio 30 to 90%, a titanium oxide deposit film is formed on the deposition surface.

On the other hand, when a zinc oxide layer is used in the present invention, the zinc oxide layer can be formed by any of well-known methods. In particular, the method of electrolytically oxidizing the surface of a metal zinc plate to form an oxide film, and method of forming a zinc oxide film by vacuum deposition are preferably used in the present invention.

For the vacuum deposition of a zinc oxide, a method of depositing metal zinc in the presence of oxygen gas to form an oxide film similar to the above-described vapor-deposition of titanium oxide, and a method of forming a zinc metal film in the absence of oxygen and then oxidizing the zinc metal film in the air by increasing the temperature to about 700° C. can be used.

The method of using alcoholate is also a method capable of forming an objective thin film without performing vapor-deposition or using a binder. It is possible to form a barium titanate thin film by coating a mixed alcohol solution of barium ethoxide and titanium butoxide on a silicon substrate having $SiO_2$ on the surface, hydrolyzing the coated surface and then heating to 200° C. or higher. This method can be applied to the formation of a thin film of the above-described other $RTiO_3$ (wherein R represents an alkaline earth metal atom), $AB_{2-x}C_xD_{3-x}E_xO_{10}$ (wherein A, B, C, D and E each has the same meaning as described above) $SnO_2$, $Bi_2O_3$, and $Fe_2O_3$.

The method of forming a photocatalytic metallic oxide thin film is also a method capable of forming an objective thin film without using a binder. It is possible to form an $SnO_2$ thin film by spraying an aqueous hydrochloric acid solution containing $SnCl_4$ on the surface of quartz or crystalline glass heated to 200° C. or higher. This method can be applied to the formation of every thin film of, in addition to $SnO_2$, the above-described $RTiO_3$ (wherein R represents an alkaline earth metal atom), $AB_{2-x}C_xD_{3-x}E_xO_{10}$ (wherein A, B, C, D and E each has the same meaning as described above), $Bi_2O_3$ and $Fe_2O_3$.

In any of the above cases, the thickness of a metallic oxide thin film is from 1 to 100,000 Å, preferably from 10 to 10,000 Å, and more preferably 3,000 Å or less, to prevent distortion due to light interference. It is advantageous for the thickness of a thin layer to be 50 Å or more for exhibiting light activity function sufficiently.

When a binder is used, the volume ratio of the metallic oxide in the photocatalytic metallic oxide thin layer is from 50 to 100%, preferably 90% or more is occupied by the metallic oxide, and more preferably occupied by a continuous layer of the metallic oxide, i.e., substantially 100%.

For increasing the surface property of converting to hydrophilic by light irradiation, doping with a certain kind of a metal is effective in some cases, and for this purpose a metal having small ionization tendency such as Pt, Pd, Au, Ag, Cu, Ni, Fe or Co is preferred. A plurality of these preferred metals may be doped.

Light/Heat Convertible Layer

Light/heat convertible materials which can be provided on a substrate lamellately and are capable of absorbing irradiated light efficiently and converting it to heat are selected as a material for light/heat convertible layer. As light/heat conversion efficiency is related to light absorptivity and energy conversion efficiency of the light/heat convertible material, matching of the spectral characteristics of light to be irradiated and spectral characteristics of a light/heat convertible material is also an important factor.

Preferred example of light/heat convertible materials include the following materials.

(1) Inorganic Pigment

Chrome yellow, cadmium yellow, nickel titanium yellow, iron oxide red, cadmium red, molybdenum red, ultramarine, cobalt blue, emerald green, etc.

(2) Organic Metal Complex Pigment

Phthalocyanine complex compounds of copper, chromium, cobalt, manganese, etc. As these pigments in items (1) and (2) are sufficiently heat-resistive, safety against abrasion is high even if the temperature is increased in heat mode imaging. Further, as these pigments have broad absorption spectrum regions, radiant rays are not necessary to be infrared rays. For example, they have such an advantage that they can easily effect local heating of 100° C. or higher by irradiation with continuous spectrum xenon flash light showing a luminous maximum at 500 to 600 nm with short time high illumination intensity in combination with a high capacity condenser.

(3) Organic Pigment

Triphenylmethane-based, quinacridone-based, perylene-based, isoindolinone-based, dioxazine-based, quinophthalone-based, monoazo-based and disazo-based pigments are heat-resistive, have high light absorptivity and are excellent light/heat convertible materials. Specific examples thereof include Chromophthal Scarlet R, Perylene Red 178, Benzimidazolone Carmine HP4C, Lake Red C, Rhodamine 6G Lake, Permanent Red FGR, Permanent Bordeaux FGR, Quinacridone Magenta 122, and Yellow H10GL.

In addition, commercially available pigments, and pigments described in *Color Index* (*C. I.*) *Handbook, Saishin Ganryo Binran* (*The Latest Pigment Handbook*), compiled by Nihon Ganryo Gijutsu Kyokai (1977), *Saishin Ganryo Oyo Gijutsu* (*Application Techniques of the Latest Pigment*), CMC Publishing Co. (1986), and *Insatsu Ink Gijutsu* (*Techniques of Printing Ink*), CMC Publishing Co. (1984) can be used in the present invention.

The particle size of pigments is preferably from 0.01 to 10 μm, more preferably from 0.05 to 1 μm, and particularly preferably from 0.1 to 1 μm. When the particle size of pigments is less than 0.01 μm, the stability of a dispersion product in a photosensitive layer-coating solution is inferior, while when it exceeds 10 μm, an image-recording layer produced becomes uneven.

Well-known dispersing methods used in the production of inks and toners can be used for dispersing pigments. A dispersing machine such as an ultrasonic disperser, a sand mill, an attriter, a pearl mill, a super mill, a ball mill, an impeller, a disperser, a KD mill, a colloid mill, Dynatron, a three-roll mill, and a pressure kneader can be used for dispersion. Details of these are described in *Saishin Ganryo Oyo Gijutsu*, CMC Publishing Co. (1986).

Each organic pigment described in item (3) also shows absorbance in the visible ray region and, the same as the pigments in (1) and (2), functions as a light/heat convertible layer either with infrared rays or visible rays with high intensity of illumination.

(4) Inorganic Metal Simple Substance and Compound

Inorganic metals, in particular heavy metals, also have infrared ray absorbing characteristics. Accordingly, both a continuous layer of a metal thin film and a dispersion layer of metal fine particles can be used as a light/heat convertible layer.

Examples of such metals include Mg, Al, Si, Ti, V, Cr, Mn, Fe, Co, Ni, Cu, Zn, Ga, Ge, Y, Zr, Nb, Mo, Tc, Ru, Pd, Cd, In, Sn, Sb, Hf, Ta, W, Ag, Au, Re, Os, Ir, Pt, Pb, etc. Of these metals, silver, gold, silicon, germanium, germanium-arsenic compounds, indium, and phosphorus compounds are preferred.

A silver colloid dispersion in which metal powders have an average particle size of from 5 to 150 nm is less dependent upon radiant rays because the dispersion has high absorption coefficient to radiant rays of every wavelength of from visible ray region to infrared ray region. On the other hand, silicon, germanium, germanium-arsenic compounds, indium, and phosphorus compounds have high light/heat conversion action to infrared rays, and absorption wavelength end of each of them are 1,150, 1,800, 1,800 and 930 nm, respectively. That is, they have light/heat conversion action to radiant rays shorter than these absorption wavelength ends.

(5) Metallic oxide

ITO (indium oxide doped with tin), chromium oxide, and oxides of transition metal elements can be exemplified.

(6) Dye Series Light/Heat Convertible Substance

Well-known commercially available dyes and dyes described in literature (e.g., *Senryo Binran* (*Dye Handbook*), compiled by Yuki Gosei Kagaku Kyokai, 1970) can be used as a light/heat convertible substance in the present invention. Specifically, an azo dye, a metal complex salt azo dye, a pyrazolone azo dye, an anthraquinone dye, a phthalocyanine dye, a carbonium dye, a quinonimine dye, a methine dye, a cyanine dye, and a metal thiolate complex can be exemplified as such dyes.

There can be cited as preferred dyes, for example, cyanine dyes disclosed in JP-A-58-125246, JP-A-59-84356, JP-A-59-202829, and JP-A-60-78787; methine dyes disclosed in JP-A-58-173696, JP-A-58-181690, and JP-A-58-194595; naphthoquinone dyes disclosed in JP-A-58-112793, JP-A-58-224793, JP-A-59-48187, JP-A-59-73996, JP-A-60-52940, and JP-A-60-63744; squarylium dyes disclosed in JP-A-58-112792; cyanine dyes disclosed in British Patent 434,875; near infrared absorbing sensitizers disclosed in U.S. Pat. No. 5,156,938; substituted arylbenzo(thio) pyrylium salts disclosed in U.S. Pat. No. 3,881,924; and trimethine thiapyrylium salts disclosed in JP-A-57-142645 (corresponding to U.S. Pat. No. 4,327,169).

Of these dyes, particularly preferred dyes are a cyanine dye, a squarylium dye, a pyrylium salt and a nickel thiolate complex.

(7) Others

Carbon black is well known as an excellent light/heat convertible substance which is not dependent upon radiation spectrum as well as silver colloid fine particles. Silica particles are also preferred light/heat convertible substance. Carbon graphite, iron sulfide and chromium sulfite can also be used as a light/heat convertible substance.

(8) Self Exothermic Powder

If a light/heat convertible substance is a self exothermic substance, not only heat energy converted from radiant energy is supplied to a photocatalytic metallic oxide thin layer temporarily, but also the reaction heat of self exothermic reaction can be supplied continuously. Therefore, a self exothermic light/heat convertible substance is more effective as compared with a light/heat convertible substance not having self exothermic property from the viewpoint of capable of particularly largely amplifying the altering function of surface physical property by heat. Examples of such self exothermic light/heat convertible substances include the following compounds.

Particularly preferred light/heat convertible substances are metal powders or powders of metal compounds. The system of self exothermic reaction is constituted by the combination with the oxygen in the air. Specific examples of self exothermic light/heat convertible substances include metal, metallic oxide, metallic nitride, metal sulfide, and metallic carbide.

a. Self Exothermic Metal Powder

Of the above-described metal powders, self exothermic metal powders are preferably applicable for the object of the present invention because they particularly easily cause an exothermic reaction such as an oxidation reaction and the like by heat energy. Specifically, Al, Si, Ti, V, Cr, Mn, Fe, Co, Ni, Cu, Zn, Y, Zr, Mo, Ag, In, Sn, and W are preferred. In particular, Fe, Co, Ni, Cr, Ti and Zr are preferred in view of having high absorption rate of radiant rays and large self exothermic reaction heat energy.

These metals may comprise alone or may consist of two or more. Constitutions comprising metals with metallic oxides, metallic nitrides, metallic sulfides, or metallic carbides may also be used. A metal simple substance rather gives large self exothermic reaction heat energy such as oxidation etc. but treatment in the air is complicated and a metal simple substance is attended with danger of spontaneous combustion when comes in contact with the air. Therefore, several nanometers in thickness from the surface is preferably covered with oxides, nitrides, sulfides or carbides.

These compounds may be particles or thin films such as vapor-deposited films, but particles are preferred when organic substances are used in combination. The particle size is 10 $\mu$m or less, preferably from 0.005 to 5 $\mu$m, and more preferably from 0.01 to 3 $\mu$m. When the particle size is 0.01 $\mu$m or less, dispersion of particles are difficult and when 10 $\mu$m or more, definition of printed matters is deteriorated.

The content of these particles in a light/heat convertible layer is preferably from 2 to 95% by weight, more preferably from 5 to 90% by weight. If the content is 2% by weight or less, calorific power becomes short, while when 95% by weight or more, the film strength is lowered.

Further, the transmission density of a light/heat convertible layer is preferably from 0.3 to 3.0 measured based upon the International Standardization Organization ISO5-3 and ISO5-4. If the transmission density exceeds 3.0, aberration is liable to occur. While when it is 0.3 or less, radiant ray energy is not sufficiently absorbed, as a result, the heat energy obtained by light/heat conversion is often insufficient.

Of the above-described metal fine powders, iron powders are preferably used. Any iron powders are preferably used. Above all, iron alloy powders containing $\alpha$-Fe as a main component are preferred. These powders may contain, in addition to the prescribed atoms, the following atoms, e.g., Al, Si, S, Sc, Ca, Ti, V, Cr, Cu, Y, Mo, Rh, Pd, Ag, Sn, Sb, Te, Ba, Ta, W, Re, Au, Hg, Pb, Bi, La, Ce, Pr, Nd, P, Co, Mn, Zn, Ni, Sr and B. In particular, it is preferred to contain at least one of Al, Si, Ca, Y, Ba, La, Nd, Co, Ni and B, in addition to α-Fe, and more preferably at least one of Co, Y and Al is contained in addition to α-Fe. The content of Co is preferably from 0 to 40 atomic %, more preferably from 15 to 35 atomic %, and most preferably from 20 to 35 atomic %, the content of Y is preferably from 1.5 to 12 atomic %, more preferably from 3 to 10 atomic %, and most preferably from 4 to 9 atomic %, the content of Al is preferably from 1.5 to 12 atomic %, more preferably from 3 to 10 atomic %, and most preferably from 4 to 9 atomic %, each based on Fe. Iron alloy powders may contain a small amount of a hydroxide or an oxide. Specific examples thereof are disclosed in JP-B-44-14090, JP-B-45-18372, JP-B-47-22062, JP-B-47-22513, JP-B-46-28466, JP-B-46-38755, JP-B-47-4286, JP-B-47-12422, JP-B-47-17284, JP-B-47-18509, JP-B-47-18573, JP-B-39-10307, JP-B-46-39639, U.S. Pat. Nos. 3,026,215, 3,031,341, 3,100,194, 3,242,005, and 3,389,014.

Iron alloy fine powders can be prepared by well-known processes, such as a method comprising reducing a composite organic acid salt (e.g., organic acid salt comprising mainly an oxalate) with a reducing gas, e.g., hydrogen; a method comprising reducing iron oxide with a reducing gas, e.g., hydrogen, to obtain Fe or Fe—Co particles; a method comprising pyrolysis of a metal carbonyl compound; a method comprising adding to an aqueous solution of a ferromagnetic metal a reducing agent, e.g., sodium borohydride, hypophosphite, or hydrazine, to perform reduction; and a method comprising evaporating a metal in a low pressure inert gas to obtain fine powders. The thus-obtained ferromagnetic alloy powders which are subjected to well-known gradual oxidization treatment can be used in the present invention, e.g., a method comprising immersing powders in an organic solvent, then drying; a method comprising immersing powders in an organic solvent, then charging an oxygen-containing gas to form oxide films on the surfaces thereof and drying; and a method comprising forming oxide films on the surfaces of the powders by regulating partial pressure of an oxygen gas and an inert gas without using an organic solvent.

Iron alloy powders which can be preferably used in the present invention have a specific surface area ($S_{BET}$) as measured by the BET method of from 20 to 80 $m^2/g$, preferably from 40 to 60 $m^2/g$. When $S_{BET}$ is less than 20 $m^2/g$, surface property is deteriorated, and when more than 80 $m^2/g$, good dispersibility is obtained with difficulty, which is not preferred. Iron alloy powders according to the present invention have a crystallite size of generally from 80 to 350 Å, preferably from 100 to 250 Å, and more preferably from 140 to 200 Å. The length of a long axis of iron alloy powders is generally from 0.02 to 0.25 μm, preferably from 0.05 to 0.15 μm, and more preferably from 0.06 to 0.1 μm. Iron alloy powders preferably have an acicular ratio of from 3 to 15, more preferably from 5 to 12.

b. Lower Metallic Oxide Powder

A case in which the metallic oxide itself is a lower oxide of a polyvalent metal and is a light/heat convertible material and, at the same time, is a self exothermic type air oxidation reactant is included. Specifically, ferrous oxide, triiron tetroxide, titanium monoxide, stannous oxide, and chromium(II) oxide can be exemplified.

c. Metallic Nitride Powder

Preferred metallic nitrides are azide compounds of metals, in particular, azide compounds of copper, silver and tin are preferred. These azide compounds generate heat byphotolysis and cause the succeeding pyrolytic reaction.

d. Metallic Sulfide Powder

Preferred metallic sulfides are heavy metallic sulfides of radiant ray-absorptive transition metals. Preferred metallic sulfides above all are silver sulfide, ferrous sulfide, and cobalt sulfide. In these cases, material series comprising sulfur of simple substance and a self exothermic reactant such as alkali carbonate in coexistence are used.

Whether this self-exothermic reaction occurs or not can be easily confirmed by differential thermobalance (TG/DTA) (thermogravimetry/differential thermal analysis). When a self-exothermic reactant is inserted into a differential thermobalance and the temperature is raised at a constant rate, an exothermic peak appears at a certain temperature, by which the fact of an exothermic reaction having occurred can be confirmed. When an oxidation reaction of metal or lower metallic oxide is used as a self-exothermic reaction, the weight increase is also observed in the thermobalance as well as the appearance of the exothermic peak. As is the repetition of the above, by the use of the energy by a self exothermic reaction in addition to a light/heat conversion mechanism, more heat energy per a unit radiant ray amount than that conventionally used can be used and moreover continuously, as a result, sensitivity can be improved.

The heat energy generated by a self exothermic reaction works as a heat source to accelerate the conversion of a thin layer to lipophilization.

Image-Forming Method

The thin layer has the property that the surface of the layer becomes hydrophilic by the irradiation with active light. By utilizing this property, a hydrophilic area formed on the exposed surface by the imagewise exposure with active light is brought into contact with ink, thereby the printing plate the image area of which has received ink is formed. After printing has been finished, the remaining ink on the used printing plate is removed by cleaning, then the printing plate precursor is evenly heated at 80° C. or higher, thus the hydrophilized surface layer exposed is restored to the original hydrophobic property and all the surface becomes a uniform ink-receiving hydrophobic surface, thereby the printing plate precursor is reclaimed. Accordingly, printing can be performed repeatedly using such a printing plate precursor, which is the fundamental offset printing technique according to the present invention.

A phenomenon that the surface of the above-described metallic oxide is hydrophilized by a photocatalytic reaction is well-known as disclosed in JP-A-9-70541 and JP-A-9-77535. The surface of the metallic oxide can be made hydrophilic and it is also possible to make the surface hydrophobic by heating. The conception of applying new system of repeatedly using a precursor to offset printing is a novel technical idea.

In the present invention, image formation on the printing plate can be selected from various methods making use of hydrophilization by active light and lipophilization by heating or irradiation with light/heat convertible radiant rays. Several typical methods are described in the first place.

1) A method comprising irradiating the entire surface of the thin layer on the surface of a printing plate precursor with active light to make all over the surface of the thin layer hydrophilic, and imagewise exposing the surface of the thin layer with radiant rays to convert the exposed area with the radiant rays to lipophilic, to thereby form a printing plate in which the lipophilic part is imagewise receptive to ink.

This method is a direct image-recording method by the irradiation with light/heat convertible radiant rays. The light/heat convertible radiant rays are preferably infrared rays or laser beams. The radiant rays are modulated by the image. Modulation may be effected by electrical means or by physically optical means, i.e., may be laser beams carrying electronic image information or may be infrared ray irradiation through an image mask such as a negative film.

The radiant rays may be, in addition to infrared rays and laser beams, visible rays such as the light of a xenon electric discharge lamp and high illumination intensity short time flash light discharged from a high capacity condenser.

2) A method comprising irradiating the entire surface of the thin layer on the surface of a printing plate precursor with active light to make all over the surface of the thin layer hydrophilic, and imagewise heating the surface of the thin layer to convert the heated part to lipophilic, to thereby form a printing plate in which the lipophilic part is imagewise receptive to ink.

For example, a system of directly performing writing from a printing head to a heat-sensitive printer by means of heat is used.

3) A method comprising irradiating the entire surface of a printing plate precursor with light/heat convertible radiant rays, and imagewise irradiating the lipophilized thin layer with active light to convert the irradiated part to hydrophilic.

In this method, a lipophilic ink-received printing plate is formed on the part which has not been irradiated with active light.

In this method, the part which has been subjected to imagewise irradiation is hydrophilic, i.e., an ink-repellent part. Consequently, according to this method, a printing plate reverse in negative/positive relationship to the method in the above item 1), wherein the part subjected to imagewise irradiation is a lipophilic and ink-receiving part, can be obtained. Contrary to the above item 1), wherein light/heat convertible radiant rays are used for imagewise irradiation, ultraviolet rays which excite the thin layer surface photochemically to make the surface hydrophilic, relatively short wave visible rays, and weak laser beams of a degree so as not to cause light/heat conversion are used in this case. Rays of light themselves may be image-modulated or irradiation may be performed through an image-like mask.

A preferred example of the system according to this method includes a system comprising previously writing an electrophotographic image, an ink jet image, a heat-sensitive transfer image, handwritten water drawing in pen and oil drawing in pen, etc., directly on the thin layer surface which has been made lipophilic entirely, then irradiating all over the surface of the thin layer with active light to make a printing plate, and printing. In this case, the written image may be lipophilic or hydrophilic but, when the image is hydrophilic, except for the case of image-forming substance being easily soluble in a fountain solution, the image area is removed after irradiation with active light to make the thin layer surface capable of receiving ink. When the image is lipophilic, this procedure is not necessarily required.

Another characteristic image-forming method using the printing plate precursor according to the present invention is that a printing image plane can be easily revised and a revised edition can be made by partially irradiating the precursor with light/heat convertible radiant rays and active light respectively to thereby perform partial erasure and writing.

In any of the above items 1), 2) and 3), the method according to the present invention is advantageous in the points of simplicity and reclamation of the printing plate precursor. Therefore, the method of the present invention can be preferably used as simple optical recording/offset printing means of recording laser beams carrying image information and printing.

Plate-Making

Various forms and materials can be used for the printing plate according to the present invention. For instance, a method of providing an oxide layer of a photocatalytic metallic oxide directly on the surface of a plate cylinder of a printer by the above-described method such as depositing, immersing or coating, and a method of providing a layer of photocatalytic metallic oxide on the surface of a metal plate and winding the metal plate around a plate cylinder to make a printing plate can be used.

A printing plate precursor having a surface layer comprising a photocatalytic metallic oxide is originally lipophilic and ink-receptive, but when the printing plate precursor is imagewise irradiated, the exposed area becomes hydrophilic and ink-repellent.

"The change between hydrophilic and lipophilic due to light irradiation", which is the fundamental concept of the present invention, is extremely conspicuous. The larger the difference between hydrophilicity and lipophilicity of the image area and the non-image area, the larger is the discriminating effect, and the printing plate becomes clear and the printing durability (i.e., press life) also becomes high. The difference between hydrophilicity and lipophilicity can be expressed by the contact angle with a water droplet. The larger the hydrophilicity, the water droplet expands and the contact angle becomes small, and in the case of repelling water (water-repellent, i.e., lipophilic) in contrast with this, the contact angle becomes large. That is, the printing plate precursor having a surface layer of a photocatalytic metallic oxide according to the present invention originally has a high contact angle with water but the contact angle rapidly lowers when irradiated with active light and the property changes to repel lipophilic ink. As a result, an ink-receiving area and a water-receiving area are imagewise formed on the printing plate and ink is transferred to an image-receiving sheet such as paper by contact with the printing plate.

Active Light Irradiation

Active light exciting the thin layer comprising a photocatalytic metallic oxide as a main component has a photosensitive region at 400 nm or lower, accordingly a mercury lamp, a tungsten halogen lamp, other metal halide lamps, a xenon lamp, and a discharge tube discharging ultraviolet rays can be used as an active light source. Further, as an excitation light source, a helium cadmium laser having oscillation wavelength at 325 nm and a water-cooled argon laser having oscillation wavelength at 351.1 to 363.8 nm can also be used. Further, in gallium nitride laser in which near ultraviolet oscillation has been confirmed, InGaN series semiconductor laser having oscillation wavelength at 360 to 440 nm, and $MgO\text{-}LiNbO_3$ reversed domain wavelength converter type laser having oscillation wavelength at 360 to 430 nm can also be applied.

In proportion to the quantity of radiation, the photocatalytic metallic oxide constituting the surface layer is gradually changed to hydrophilic by light absorption excitation, and when the photocatalytic metallic oxide which constitutes the surface layer is completely activated, the degree of the hydrophilicity does not proceed further even if irradiation is continued.

Preferred intensity of the light irradiated varies according to the property of the image-forming layer comprising a photocatalytic metallic oxide, the wavelength and the relative spectral distribution of the light but generally (surface) exposure strength before modulation by printing image is from 0.05 to 100 joule/cm$^2$, preferably from 0.05 to 10 joule/cm$^2$, and more preferably from 0.05 to 5 joule/cm$^2$.

This quantity of radiation is a quantity applicable to a laser scanning system or a (surface) exposure system using a divergent type light source without any impediment.

The photosensitivity which causes the above-described conversion from lipophilicity to hydrophilicity is different from the photosensitivity of the zirconia ceramic disclosed in JP-A-9-169098 in property and constitution. For example, as to the sensitivity, there is disclosed in the above patent that laser beams of 7 W/$\mu$m$^2$ are used for the zirconia ceramic, which corresponds to 70 joule/cm$^2$ taking the pulse duration of the laser beams to be 100 nanoseconds. As compared with the sensitivity of the photocatalytic metallic oxide layer, the sensitivity of the zirconia ceramic is lower than that of the photocatalytic metallic oxide layer by about a figure. Although not having been sufficiently clarified mechanically, this is thought to be the peeling reaction by light of lipophilic organic substance adhered and is different from the mechanism of change by light of the zirconia.

After image printing on the surface layer of the lipophilic photocatalytic metallic oxide and exposure, the printing plate precursor can be sent to offset printing process as it is without development processing.

Light/Heat Convertible Radiant Ray Irradiation

When light/heat convertible radiant ray irradiation is used for writing of an image, either a (surface) exposure system or a scanning system may be used. The former is a system comprising irradiating high illumination intensity short time light on the printing plate precursor and generating a large amount of heat by light/heat conversion. A preferred irradiation system is a flash lamp comprising the above-described xenon flash electric discharge lamp and a high capacity condenser, or an infrared ray lamp. When a (surface) exposure light source such as an infrared ray lamp is used, a preferred exposure amount also varies according to the illumination intensity, but generally (surface) exposure strength before modulation by printing image is preferably from 0.05 to 10 joule/cm$^2$, and more preferably from 0.05 to 5 joule/cm$^2$. When the substrate is transparent, the same amount of energy may be exposed from the back side of the substrate through the substrate.

It is preferred to select the exposure illumination intensity so as to obtain the above exposure strength within the exposure time of generally from 0.01 to 1 msec, preferably from 0.01 to 0.1 msec. When irradiation time is long, it becomes necessary to increase the exposure strength from the competitive relationship between the generating speed of the heat energy and the diffusion speed of the heat energy.

In the case of necessitating increasing the exposure strength, scanning is performed on the printing plate precursor using laser light sources containing a large amount of infrared ray components with modulating the laser beams by printing image. Examples of laser light sources include a semiconductor laser, a helium-neon laser, a helium-cadmium laser, and a YAG laser. Irradiation is preferably performed with laser beams having peak output of 1,000 W, preferably 2,000 W. In this case, exposure amount is preferably in (surface) exposure strength before modulation by printing image of from 0.03 to 10 joule/cm$^2$, preferably from 0.05 to 5 joule/cm$^2$. When the substrate is transparent, exposure may be performed from the back side of the substrate through the substrate.

As has been described, the originally lipophilic surface layer of photocatalytic metallic oxide converts to hydrophilic by the irradiation with active light, and the hydrophilized surface becomes lipophilic by the irradiation with light/heat convertible radiant rays. In particular, extreme increment is observed in the sensitivity of light/heat convertible radiant rays in the latter lipophilization due to the provision of a light/heat convertible layer and, when compared with the case not provided with the light/heat convertible layer, the discriminability of a lipophilic area from a hydrophilic area is improved. As a result, an excellent printed image having less printing stain can be obtained even when image exposure has been conducted with a small amount of exposure. Moreover, as both of active light and light/heat convertible radiant rays can be modulated by images, image printing exposure can be effected, and image-forming methods can be selected as described above in items 1), 2) and 3). According to the present invention, a non-processing printing plate precursor can be prepared by simple operation as has been described and the printing plate precursor can be sent to offset printing process as it is.

Accordingly, the printing method according to the present invention has various advantages represented by simplicity as compared with well-known lithographic printing methods. That is, as described above, chemical treatment with an alkaline developing solution is not necessary, as a result, accompanied operations such as wiping and brushing are not necessary, and further, increase in environmental load due to discard of developing waste solutions does not follow.

The entirely exposed area of the thus-obtained lithographic printing plate has been sufficiently hydrophilized but, if desired, it may be subjected to post-treatment using washing water, a rinsing solution containing a surfactant and the like, a desensitizing solution containing gum arabic and starch derivatives. When the image-recording material according to the present invention is used as a printing material, these treatments can be used in various combinations.

As such a method, a method of coating on the lithographic printing plate using sponge or absorbent cotton impregnated with the (plate) burning conditioner, or a method of coating by immersing the printing plate in a vat filled with (plate) burning conditioner, or a method of coating using an automatic coater can be applied. Making the coating amount of the (plate) burning conditioner even using a squeegee or a squeegee roller after coating gives a preferred result. The coating amount of the (plate) burning conditioner is generally appropriately from 0.03 to 0.8 g/m$^2$ (in dry weight).

The lithographic printing plate obtained through these treatments is set in an offset printer and used for printing of a large number of sheets.

Reclamation of Printing Plate Precursor

Reclaiming process of a printing plate after printing is described below.

The ink adhered to a printing plate after printing is removed by washing using a hydrophobic petroleum-based solvent. As the solvent, commercially available ink dissolving solutions, such as aromatic hydrocarbon, e.g., kerosine and Isopar, can be used. Benzol, toluol, xylol, acetone, methyl ethyl ketone and mixtures of these may also be used.

A printing plate having been subjected to removal by washing of ink is then subjected to heat treatment, thereby all over the printing plate becomes lipophilic uniformly. The thus-lipophilized printing plate is restored to uniform photosensitivity to hydrophilicity. The heat treatment is performed by bringing the printing plate into contact with a high temperature body such as a heating roller, inserting the plate into a constant temperature bath or a heating oven, irradiation with heat rays such as infrared rays, and other arbitrary heating means, at surface temperature of 80° C. or higher, preferably 100° C. or higher, and lower than the calcination temperature of titanium oxide or zinc oxide. The higher the temperature, the shorter is the time required for lipophilization. The conditions of the heat treatment are preferably at 150° C. for 10 minutes or longer or at 200° C. for 1 minute or longer, alternatively at about 250° for about 10 seconds or longer. The heat treatment time may be prolonged but further advantage cannot be progressed after the plate is restored to hydrophilicity.

Any arbitrary means can be employed as a heat source for reclamation so long as the above temperature and time conditions are satisfied. As examples of heating means, radiation heating by direct irradiation by infrared rays, indirect irradiation by infrared rays by bringing heat ray-absorbing sheet such as black carbon paper into contact with the printing plate surface, insertion of the plate into an air temperature controlled bath set at constant temperature, and a contact heating with a hot plate or other heating plates can be exemplified.

The printing plate precursor thus-reclaimed from the used printing plate is stored for the next printing so as to keep out of the exposure to active light.

Although it is not completely grasped, the number of times of recycling for reclaiming of the printing plate precursor according to the present invention is at least 15 times, and it is thought that the times are restricted by unremovable stain, scratches on the plate surface repairing of which is impractical, and mechanical deformation (distortion) of the plate.

EXAMPLE

The present invention is described in detail below with reference to the examples, but the present invention should not be construed as being limited thereto.

Example I-1

A polyethylene terephthalate (PET) substrate having a thickness of 150 $\mu$m was set in a sputtering apparatus and evacuated to $5\times10^{-7}$ Torr. The substrate was heated at 100° C., argon gas was introduced to the apparatus and gas pressure was adjusted to $5\times10^{-3}$ Torr. RF power 150 W was applied to a silicon target having a diameter of 6 inches, and a silicon thin film having a film thickness of 1,500 Å was formed. Subsequently, the inside of the sputtering apparatus was again evacuated to $5\times10^{-7}$ Torr. The PET substrate vapor-deposited with a silicon thin film was heated at 150° C., the atmosphere was replaced with argon/oxygen mixed gas (30/70 by molar ratio), and the gas pressure was adjusted to $5\times10^{-3}$ Torr. RF power 200 W was applied to a titanium target having a diameter of 6 inches, thus a titanium oxide thin film having a film thickness of 1,000 Å was formed.

The thus-obtained sample was heated in an oven at 120° C. for 3 hours, and then allowed to stand to cool. After the temperature of the sample was lowered to room temperature, the sample was subjected to entire surface irradiation with a high pressure mercury lamp at illumination intensity of 1.37 mW/cm$^2$ for 5 minutes. Then, a part of the sample was exposed using an LD laser light source of 908 nm on the following conditions.

Output: 750 mW

Laser beam diameter: 28 $\mu$m

Scanning speed: 270 cm/sec

This plate was set in Oliver 52 single-sided printer (manufactured by Sakurai Co., Ltd.), pure water as a fountain solution was supplied on the printing plate surface with rotating a molten roller 20 times, and an ink roller was touched to the plate surface and offset printing was performed. The ink used was New Champion F Gloss 85 Chinese Ink [i.e., black ink] (manufactured by Dainippon Chemicals and Ink Co., Ltd.). In the course of performing offset printing of 500 sheets, from beginning to end of printing, ink adhered well to the laser-exposed area and the non-exposed area was not stained, thus clear printed matters were obtained. The printing plate was not damaged.

The surface of the plate was then cleaned carefully using waste impregnated with printing ink cleaner, Dai-Clean R (manufactured by Dainippon Chemicals and Ink Co., Ltd.) to remove the ink. The plate was heated in an oven at 120° C. for 3 hours, and then allowed to stand to cool to room temperature.

The cycle of entire surface irradiation with active light, image exposure by laser beams, and the succeeding offset printing was repeated 3 times using the reclaimed printing plate precursor.

Printed matters obtained by the repetition were also clear products similar to those obtained in the first printing, and ink was adhered well to the laser-exposed area and the non-exposed area was not stained. The printing plate was not damaged.

Comparative Example I-1

A polyethylene terephthalate (PET) substrate having a thickness of 150 $\mu$m was set in a sputtering apparatus and evacuated to $5\times10^{-7}$ Torr. A titanium oxide thin film was directly provided on the substrate under the same conditions as in Example I-1 without performing silicon thin film-forming operation performed in Example I-1.

The thus-obtained sample was heated in an oven at 120° C. for 3 hours, and then allowed to stand to cool. After the temperature of the sample was lowered to room temperature, the sample was subjected to entire surface irradiation with a high pressure mercury lamp at illumination intensity of 1.37 mW/cm$^2$ for 5 minutes in the same manner as in Example I-1. Then, a part of the sample was exposed using an LD laser light source of 908 nm in the same manner as in Example I-1.

This plate was set in Oliver 52 single-sided printer (manufactured by Sakurai Co., Ltd.), and offset printing was performed under the same conditions as in Example I-1. The obtained printed matters were not clear, a laser-exposed area and non-exposed area could not be discriminated sufficiently, ink did not adhere well to the laser-exposed area and stain of the white background was a little observed.

These results show that according to the method of the present invention, the entire surface of the printing plate becomes hydrophilic by the entire surface irradiation with active light, then the light/heat convertible layer is image-wise irradiated with laser beams and the irradiated area becomes lipophilic, thus offset printing can be effected. At the same time, it was also shown that the printing plate precursor could be reclaimed through removal of ink by cleaning, exposure of the entire surface of the plate to active light and exposure of the light/heat convertible layer to laser beams. On the other hand, printed matters could be obtained even in comparative example not having a light/heat convertible layer, but sufficient sensitivity could not be obtained with the light intensity of laser exposure of the present invention, therefore, the discriminability of the lipophilic area from the hydrophilic area was inferior.

Examples I-2 and I-3, and Comparative Example I-2

On a polyethylene terephthalate (PET) substrate having a thickness of 150 $\mu$m, the following polymer dispersion of iron fine powder was coated in Example I-2, and the following polymer dispersion of iron oxide powder was coated in Example I-3, each as a light/heat convertible layer in a coating thickness of 5 μm using a bar coater. After coating, the coated layer was heated at 120° C. for 3 hours and the solvent was removed.

Coating Dispersion of Iron Fine Powder

α-Iron alloy fine powder, which was described above as particularly preferred self exothermic fine particles, having Fe/Co/Al/Y ratio of 100/5/5/5, a long axis length of 0.1 μm, a short axis length of 0.02 μm, and specific surface area of 50 $m^2/g$ was kneaded with the following polymer (also referred to as "high molecular compound") by a continuous kneader, then dispersed by a sand mill.

Ten (10) grams of this fine powder was kneaded with 3 g of polyvinyl acetate, 0.06 g of Megafac F-177 (manufactured by Dainippon Chemicals & Ink Co., Ltd., a fluorine surfactant) , 20 g of methyl ethyl ketone, and 7 g of methyl alcohol to prepare a coating dispersion.

Coating Dispersion of Iron Oxide Fine Powder

A coating dispersion was prepared using the same components as above in the same amounts and in the same manner as above except that ferrite (γ-iron oxide, $Fe_2O_3$) was used in place of the above iron fine powder, and polyvinyl acetate was used as a binder.

In Comparative Example I-2, the same PET substrate as in Examples I-2 and I-3 was used but a light/heat convertible layer was not provided.

The above-prepared three PET substrate samples were set in a sputtering apparatus and evacuated to $5\times10^{-7}$ Torr. Each of PET samples was heated at 150° C., the atmosphere was argon/oxygen mixed gas (30/70 by molar ratio), and the gas pressure was adjusted to $5\times10^{-3}$ Torr. RF power 200 W was applied to a titanium target having a diameter of 6 inches, thus a titanium oxide thin film having a film thickness of 1,000 Å was formed.

Each sample was subjected to entire surface irradiation with a high pressure mercury lamp at illumination intensity of 1.37 $mW/cm^2$ for 5 minutes in the same manner as in Example I-1. Then, a part of the sample was exposed using an LD laser light source of 908 nm in the same manner as in Example I-1. The same procedures as in Example I-1 were repeated in the subsequent printing and reclamation and repeat use of the printing plate, provided that repeat use was performed eight times.

In Example I-2, in the course of performing offset printing of 500 sheets, from beginning to end of printing, ink was adhered well to the laser-exposed area and the non-exposed area was not stained, thus clear printed matters were obtained. The printing plate was not damaged. Printed matters obtained by the repetition of eight times were also clear products similar to those obtained in the first printing, and ink was adhered well to the laser-exposed area and the non-exposed area was not stained. The printing plate was not damaged.

In Example I-3, printed matters having the same quality as in Example I-1 were obtained in the first to fourth times, and from the fifth time the reduction of ink adhesion was visually observed but printing could be repeated eight times.

Comparative Example I-2 was the repetition of Comparative Example I-1 and the results were also the same. That is, the sensitivity to laser exposure was insufficient and the discriminability of the lipophilic area was inferior to those in Example I-2 and I-3.

These results show that the accelerating effect of image formation of the light/heat convertible layer of the present invention can be obtained even if the radiant ray absorbing substance of the light/heat convertible layer is replaced with iron alloy or iron oxide, and that the effect of the present invention is further conspicuous when the light/heat convertible substance is a self exothermic substance.

Example I-4

Preparation of Substrate

A rolled plate having a thickness of 0.30 mm of aluminum material (defined in JIS A1050) containing 99.5% by weight of aluminum, 0.01% by weight of copper, 0.03% by weight of titanium, 0.3% by weight of iron, and 0.1% by weight of silicon was surface-grained using a 20% by weight aqueous suspension of 400 mesh pamiston (manufactured by Kyoritsu Yogyo K. K.) and a rotary nylon brush (6,10-nylon), and then the plate was thoroughly washed with water.

The plate was immersed in a 15% by weight aqueous solution of sodium hydroxide (containing 4.5% by weight of aluminum) and etched so as to reach the dissolving amount of aluminum of 5 $g/m^2$, then washed with water, and further neutralized with 1% by weight nitric acid. Subsequently, the plate was subjected to electrolytic graining treatment in a 0.7% by weight aqueous nitric acid solution (containing 0.5% by weight of aluminum) using rectangular alternating wave form voltage (electric current ratio r=0.90, electric current wave form disclosed in JP-B-58-5796) of the anode time voltage of 10.5 V and cathode time voltage of 9.3 V, with varying the quantity of electricity of the anode time in four ways of 50, 100, 200 and 400 coulomb/$dm^2$. After washing with water, the plate was immersed in a 10% by weight aqueous solution of sodium hydroxide at 35° C. and etched so as to reach the dissolving amount of aluminum of 1 $g/m^2$, and then washed with water. The plate was immersed in a 30% by weight aqueous sulfuric acid solution at 50° C., desmutted, and washed with water.

Further, the plate was subjected to porous anodic oxide film-forming treatment in a 20% by weight aqueous sulfuric acid solution (containing 0.8% by weight aluminum) at 35° C. using direct current. That is, electrolysis was conducted at electric current density of 13 $A/dm^2$ and 2.7 $g/m^2$ of anodic oxide film weight was obtained by controlling the electrolysis time.

This substrate was washed with water, immersed in a 3% by weight aqueous solution of sodium silicate at 70° C. for 30 seconds, washed and dried.

Vapor-deposition of Light/Heat Convertible Layer and Photocatalytic Metallic Oxide Thin Layer This aluminum substrate was set in a sputtering apparatus and evacuated to $5\times10^{-7}$ Torr. The substrate was heated at 100° C., argon gas was introduced to the apparatus and gas pressure was adjusted to $5\times10^{-3}$ Torr. RF power 150 W was applied to a silicon target having a diameter of 6 inches, and a silicon thin film having a film thickness of 1,500 Å was formed. Subsequently, the inside of the sputtering apparatus was again evacuated to $5\times10^{-7}$ Torr. The substrate having a silicon thin film was heated at 500° C., and the gas pressure was adjusted to $5\times10^{-3}$ Torr so that $Ar/O_2$ became 60/40 (by molar ratio). RF power 200 W was applied to a sintered target of barium titanate having a diameter of 6 inches, thus a barium titanate thin film having a film thickness of 1,000 Å was formed. This thin film was confirmed to be polycrystalline substance by X-ray analysis. The substrate was cut to a size of 510×400 mm to prepare a sample.

A sample comprising this substrate provided thereon a barium titanate thin layer having a light/heat convertible layer was exposed at illumination intensity of 25 mW/cm$^2$ for 2 minutes using USIO printing light source apparatus, Unirec URM-600 model GH-60201X (manufactured by Ushio Electric Co., Ltd.). On the surface of this precursor sample was placed a lith film original having a negative image of 400 line/inch, and the sample and the lith film were mechanically pressed with a quartz glass plate from the above. The sample was subjected to entire surface irradiation with an infrared lamp at illumination intensity of 0.9 mW/cm$^2$for 3 minutes through the original.

The precursor sample having been subjected to printing was set in Oliver 52 single-sided printer (manufactured by Sakurai Co., Ltd.), pure water as a fountain solution was supplied on the plate surface with rotating a molten roller 20 times, and an ink roller was touched to the plate surface and offset printing was performed. The ink used was New Champion F Gloss 85 Chinese Ink (manufactured by Dainippon Chemicals and Ink Co., Ltd.). In the course of performing offset printing of 500 sheets, from beginning to end of printing, ink was adhered well to the infrared ray-exposed area and the non-exposed area was not stained, thus clear printed matters were obtained. The printing plate was not damaged.

The surface of the plate was then cleaned carefully using waste impregnated with printing ink cleaner Dai-Clean R (manufactured by Dainippon Chemicals and Ink Co., Ltd.) to remove the ink. The plate was heated in an oven at 120° C. for 3 hours, and then allowed to stand to cool to room temperature.

The cycle of entire surface irradiation with active light, image exposure by infrared rays, and the succeeding offset printing was repeated 3 times using the reclaimed printing plate precursor.

Printed matters obtained by the repetition were also clear products similar to those obtained in the first printing, and ink was adhered well to the infrared ray-irradiated area and the non-irradiated area was not smeared. The printing plate was not damaged.

Comparative Example I-3

The same aluminum substrate as used in Example I-4 was set in a sputtering apparatus and evacuated to $5\times10^{-7}$ Torr. A barium titanate thin layer was directly provided on the substrate under the same condition as in Example I-4 without performing silicon thin film-forming operation performed in Example I-1.

The entire surface hydrophilization, imagewise lipophilization and printing were performed using this sample in the same manner as in Example I-4. However, the discriminability of the lipophilic area from the hydrophilic area of the irradiated area with active light and the imagewise exposed area with infrared ray irradiation was inferior. The obtained printed matters were at an allowable level but inferior in clearness.

These results show that according to the method of the present invention, even if the kinds of the substrate and the photocatalytic metallic oxide thin layer are changed, all the surface of the printing plate becomes hydrophilic by the entire surface irradiation with active light, then the irradiated area becomes lipophilic by the irradiation with light having a large amount of infrared ray components which are absorbed by the light/heat convertible layer, thus offset printing can be effected, and also show that the method according to the present invention is sensitive to conversion to lipophilic. The results also showed that the printing plate precursor could be reclaimed through removal of ink by cleaning, exposure of the entire surface of the plate to active light and exposure of the light/heat convertible layer to infrared rays.

Example I-5

The following printing was performed using the printing plate precursor comprising aluminum substrate, the silicon light/heat convertible layer and a barium titanate photocatalytic metallic oxide thin film used in Example I-4.

The sample was subjected to entire surface irradiation with an infrared lamp at illumination intensity of 0.9 mW/cm$^2$for 3 minutes through the original used in Example I-4. The contact angle of the surface was measured according to the aerial water droplet method using CONTACT-ANGLE METER CA-D (manufactured by Kyowa Kaimen Kagaku K.K.). The contact angle against water (aerial water droplet) was 57° at exposed area. From this fact, it can be seen that the surface has become lipophilic. On the surface of this precursor sample was placed a lith film original having a positive image of 400 line/inch, and the sample and the lith film were mechanically pressed with a quartz glass plate from the above. This sample was exposed at illumination intensity of 25 mW/cm$^2$ for 2 minutes using USIO printing light source apparatus, Unirec URM-600 model GH-60201X (manufactured by Ushio Electric Co., Ltd.). The contact angle of the surface was measured according to the aerial water droplet method using CONTACT-ANGLE METER CA-D (manufactured by Kyowa Kairnen Kagaku K.K.). The contact angle against water (aerial water droplet) was 7° at exposed area. From this fact, it can be seen that the surface has become hydrophilic.

The precursor sample having been subjected to printing was set in Oliver 52 single-sided printer (manufactured by Sakurai Co., Ltd.), pure water as a fountain solution was supplied on the plate surface with rotating a molten roller 20 times, and an ink roller was touched to the plate surface and offset printing was performed. The ink used was New Champion F Gloss 85 Chinese Ink (manufactured by Dainippon Chemicals and Ink Co., Ltd.). In the course of performing offset printing of 500 sheets, from beginning to end of printing, ink was adhered well to the laser beam-exposed area and the non-exposed area was not stained, thus clear printed matters were obtained. The printing plate was not damaged.

From the above results it can be seen that even if image formation is performed by changing the combination of the hydrophilization by active light and the lipophilization by light/heat convertible radiant rays, the effect of the present invention can be obtained.

Example I-6

A polyethylene terephthalate (PET) substrate having a thickness of 150 $\mu$m having the same light/heat convertible layer of iron alloy fine powder as in Example I-2 was immersed in a 20% ethanol solution containing cesium ethoxide, titanium butoxide, lanthanum isobutoxide, and niobium ethoxide corresponding to stoichiometric ratio of $CsLa_2NbTi_2O_{10}$, and the surface of the substrate was hydrolyzed, and then heated at 200° C. or higher, and a thin layer of $CsLa_2NbTi_2O_{10}$ having a thickness of 1,000 Å was formed on the surface of the aluminum substrate.

An image was formed on this sample having a composite metallic oxide thin layer and an iron alloy light/heat convertible layer in the same manner as in Example I-3, printing was performed, and the printing plate was cleaned for reclaiming. The obtained printing plate precursor could be reused.

From the results obtained, it can be seen that the thin layer of composite metallic oxide described above as a photocatalytic metallic oxide can exhibit the effect of the present invention.

EFFECT OF THE INVENTION

The printing precursor according to the present invention comprises a surface thin layer mainly comprising photocatalytic metallic oxide and a light/heat convertible layer provided just under the thin layer. A printing image plane is formed by the combination of a hydrophilic area caused by active light irradiation and a lipophilic area caused by light/heat convertible radiant ray irradiation. According to the method of the present invention, a developing solution is not required, clear printed image can be obtained by offset printing, used printing plates can be reclaimed by heat treatment, ink stain does not occur by the repeat use of the printing plate precursor, the quality of the printed paper can be maintained, the sensitivity to radiant ray irradiation is high due to the provision of a light/heat convertible layer, improved print quality excellent in discriminability of ink-receptivity from ink-repellency can be obtained, and the number of times of recycling for reclaiming of the printing plate precursor can be improved.

A sample was prepared by controlling the applied voltage and the quantity of electricity of the anode to vary the average equivalent circle pore diameter in the electrolytic graining treatment described in Example II-1 below. A titanium oxide thin layer was provided by using this sample according to the method described in Example II-5 below, printing was performed according to the manner described in Example II-5, and the experiment of reclaiming the used printing plate and reusing the reclaimed plate was repeated.

Figure 4:
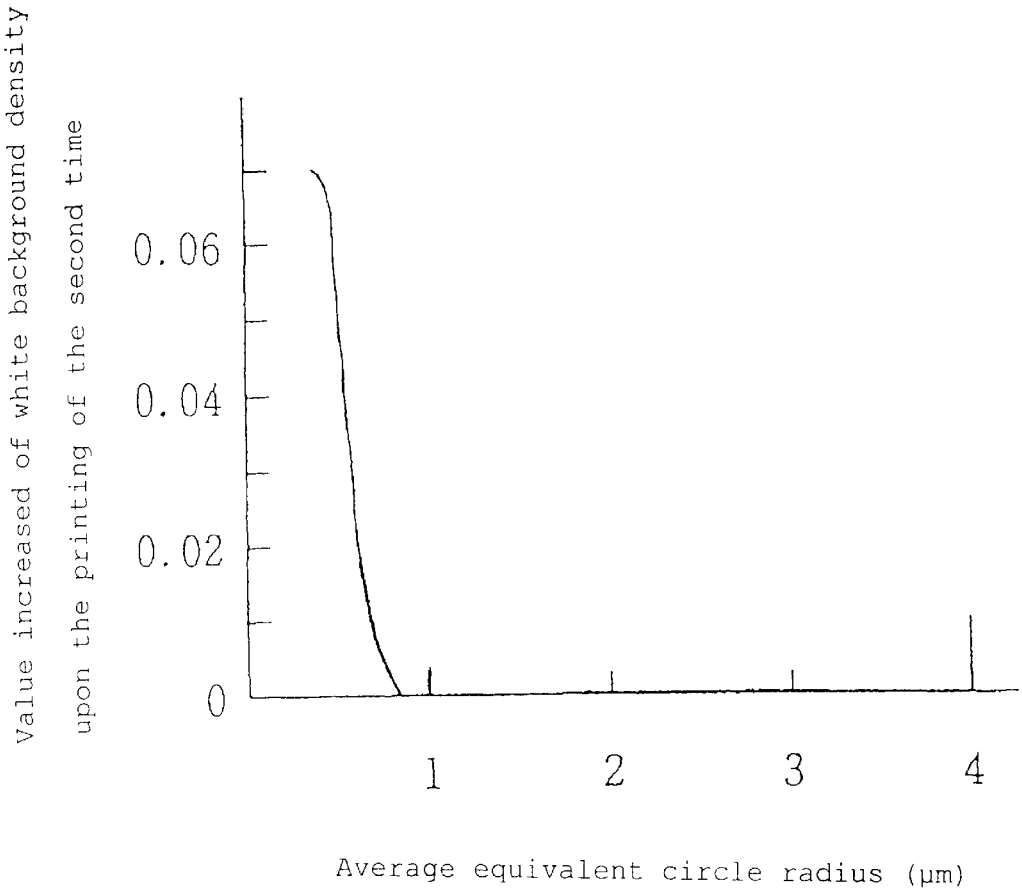
FIG. 4 is one example of an experiment showing the relationship between the degree of graining of the support surface and the stain of the white background of the printed paper.

FIG. 4 is a graph showing the relationship between the equivalent circle radius, which is the criterion of the degree of the scabrous surface (i.e., grained surface), and the stain of the white background of the printed paper. The white background density of the printed paper in the second time was shown as the ordinate and the average equivalent circle pore diameter of the sample was shown as the abscissa. The white background density was measured using a reflection densitometer satisfying the geometric condition of the measuring method of the reflection density prescribed by International Standard Organization ISO5-2 and ISO5-4.

It is shown in FIG. 4 that when the average equivalent circle pore diameter is 0.5 $\mu$m or less, the reflection density of the white background is extremely high, contrary to this, when it is from 0.5 to 0.9 $\mu$m, the white background density is extremely reduced. A printing plate precursor comprising a photocatalytic metallic oxide layer having grained surface of the average equivalent circle pore diameter of 1.0 $\mu$m or more has a preventing effect of the increment in white background density.

EXAMPLE II-1

Preparation of Substrate

A rolled plate having a thickness of 0.10 mm of aluminum material (defined in JIS A1050) containing 99.5% by weight of aluminum, 0.01% by weight of copper, 0.03% by weight of titanium, 0.3% by weight of iron, and 0.1% by weight of silicon was surface-grained using a 20% by weight aqueous suspension of 400 mesh pamiston (manufactured by Kyoritsu Yogyo K. K.) and a rotary nylon brush (6,10-nylon), and then the plate was thoroughly washed with water.

The plate was immersed in a 15% by weight aqueous solution of sodium hydroxide (containing 4.5% by weight of aluminum) and etched so as to reach the dissolving amount of aluminum of 5 g/m$^2$, then washed with water, and further neutralized with 1% by weight nitric acid. Subsequently, the plate was subjected to electrolytic graining treatment in a 0.7% by weight aqueous nitric acid solution (containing 0.5% by weight of aluminum) using rectangular alternating wave form voltage (electric current ratio r=0.90, electric current wave form disclosed in JP-B-58-5796) of the anode time voltage of 10.5 V and the cathode time voltage of 9.3 V, with varying the quantity of electricity of the anode time in four ways of 50, 100, 200 and 400 coulomb/dm$^2$. After washing with water, the plate was immersed in a 10% by weight aqueous solution of sodium hydroxide at 35° C. and etched so as to reach the dissolving amount of aluminum of 1 g/m$^2$, and then washed with water. The plate was immersed in a 30% by weight aqueous sulfuric acid solution at 50° C., desmutted, and washed with water.

Further, the plate was subjected to porous anodic oxide film-forming treatment in a 20% by weight aqueous sulfuric acid solution (containing 0.8% by weight aluminum) at 35° C. using direct current. That is, electrolysis was conducted at electric current density of 13 A/dm$^2$ and 2.7 g/m$^2$ of anodic oxide film weight was obtained by controlling the electrolysis time.

This substrate was washed with water, immersed in a 3% by weight aqueous solution of sodium silicate at 70° C. for 30 seconds, washed and dried.

The reflection density of the thus-obtained aluminum substrate measured by Macbeth RD920 reflection densitometer was 0.30, and the characteristics of the grained surface, obtained by scanning with an atomic force microscope are shown in Table 1 below.

TABLE 1

| No. of Substrate | Quantity of Electricity of Anode Time (coulomb/dm$^2$) | Average Equivalent Circle Pore Diameter ($\mu$m) | Pore Diameter Corresponding to 5% of the Cumulative Frequency Curve ($\mu$m) |
|---|---|---|---|
| 1 (Comparison) | 50 | 0.5 | 0.1 |
| 2 (Invention) | 100 | 1.1 | 0.8 |
| 3 (Invention) | 200 | 1.5 | 1.0 |
| 4 (Invention) | 400 | 2.1 | 1.4 |

This aluminum substrate was set in a sputtering apparatus and evacuated to $5\times10^{-7}$ Torr. The substrate was heated at 500° C., and the gas pressure was adjusted to $5\times10^{-3}$ Torr so that Ar/$O_2$ became 60/40 (by molar ratio). RF power 200 W was applied to a sintered target of barium titanate having a diameter of 6 inches, thus a barium titanate thin film having a film thickness of 1,000 Å was formed. This thin film was confirmed to be polycrystalline substance by X-ray analysis. The substrate was cut to a size of 510×400 mm to prepare a sample. On the surface of this precursor sample was placed a lith film original having a positive image of 400 line/inch, and the sample and the lith film were mechanically pressed with a quartz glass plate from the above. This sample was exposed at illumination intensity of 25 mW/cm$^2$ for 2 minutes using USIO printing light source apparatus, Unirec URM-600 model GH-60201X (manufactured by Ushio Electric Co., Ltd.).

This printing plate having a thin film surface of barium titanate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

The surface of the plate was then cleaned carefully using waste impregnated with printing ink cleaner Dai-Clean R (manufactured by Dainippon Chemicals and Ink Co., Ltd.) to remove the ink. The plate was heated in an oven at 150° C. for 10 minutes, and then allowed to stand to cool to room temperature. The contact angle was measured in the same manner as above. The contact angle of every place on the plate surface fell within the range of from 54 to 57° and the plate was restored to the original state of not being exposed at all.

In this condition, the plate was exposed one more time at illumination intensity of 25 mW/cm$^2$ for 2 minutes using USIO printing light source apparatus through a different lith film having a positive image. The contact angle of the surface was measured according to the aerial water droplet method in the same manner as the first time. The contact angle was 7° at exposed area (measurement was conducted at a part where irradiation was also performed in the first time), and from 54° to 56° at non-exposed area.

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. On the other hand, with a printing plate wherein substrate 1 was used, the degree of ink-stain increased from the initial stage of 500 sheet printing as compared with the first printing, although within an allowable level. The reflection density of the white background was increased by 0.02 over the first printing.

The above cycle was repeated 10 times. The reflection density of the white background of the tenth printed matters was increased by 0.06 over the first printing with substrate 1, and 0.03 with substrate 2. No ink-stain was observed with substrates 3 and 4.

Example II-2

In this Example, test was conducted by changing the kind of the thin layer to tin oxide.

Substrate 3 (Invention) and substrate 1 (Comparison) in Example II-1 were set in a sputtering apparatus and evacuated to $5\times10^{-7}$ Torr. Each substrate was heated at 120° C., and the gas pressure of argon/oxygen mixed gas (50/50 by molar ratio) was adjusted to $5\times10^{-3}$ Torr. RF power 150 W was applied to an $SnO_2$ sintered target having a diameter of 6 inches, thus a tin oxide thin film having a film thickness of 1,000 Å was formed. The substrate was cut to a size of 510×400 mm to prepare a sample.

On the surface of each sample was placed a lith film original having a positive image, and the sample and the lith film were mechanically pressed with a quartz glass plate from the above. This sample was exposed at illumination intensity of 25 mW/cm$^2$ for 10 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters in which the non-image area was not stained were obtained. The printing plate was not damaged.

The surface of the plate was then cleaned carefully using waste impregnated with printing ink cleaner Dai-Clean R (manufactured by Dainippon Chemicals and Ink Co., Ltd.) to remove the ink. The plate was heated in an oven at 180° C. for 2 minutes, thus the plate was restored to the original state.

In this condition, the plate was exposed one more time at illumination intensity of 25 mW/cm$^2$ for 10 minutes using USIO printing light source apparatus through a different lith film having a positive image.

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters were obtained. The printing plate was not damaged.

The above cycle was repeated 5 times. The sample of the present invention in which substrate 3 was used showed no change in the photosensitivity of the plate, the contact angle, and the restoration speed of the contact angle by heating, and the whiteness of the white background of the print surface was almost the same from the first time to the fifth time. On the other hand, in the comparative sample in which substrate 1 was used, ink-stain was observed on the second print surface, and the reflection density of the white background was increased by 0.06. With this comparative sample, the increase of the white background density by 0.06 to 0.10 over the first time was observed from the third on.

It can be seen from these results that even if the printing plate precursor comprising an aluminum substrate having provided thereon a tin oxide photosensitive layer is used, a thin layer having the graining degree within the scope of the present invention diminishes ink-stain.

Example II-3

Samples were prepared in the same manner as in Example II-2 using substrate 1 (Comparison) and substrate 3 (Invention) of aluminum substrate, except for varying the kind of the thin layer, and the test in Example II-2 was repeated. That is, each sample prepared was immersed in a 20% ethanol solution containing cesium ethoxide, titanium butoxide, lanthanum isobutoxide, and niobium ethoxide corresponding to stoichiometric ratio of $CsLa_2NbTi_2O_{10}$, and the surface of the substrate was hydrolyzed, and then heated at 200° C. or higher, and a thin layer of $CsLa_2NbTi_2O_{10}$ having a thickness of 1,000 Å was formed on the surface of the aluminum substrate.

The aluminum substrate having a composite metallic oxide thin film subjected to anodizing treatment was cut to a size of 510×400 mm to prepare a sample. On the surface of each sample was placed a lith film original having a positive image, and the sample and the lith film were mechanically pressed with a quartz glass plate from the above. Each sample was exposed at illumination intensity of 25 mW/cm$^2$ for 10 minutes using USIO printing light source unit, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters in which the non-image area was not stained were obtained. The printing plate was not damaged.

The surface of each plate was then cleaned carefully using waste impregnated with printing ink cleaner Dai-Clean R (manufactured by Dainippon Chemicals and Ink Co., Ltd.) to remove the ink. The plate was heated in an oven at 160° C. for 15 minutes, thus the plate was restored to the original state.

In this condition, the plate was exposed one more time at illumination intensity of 25 mW/cm$^2$ for 5 minutes using USIO printing light source apparatus through a different lith film having a positive image.

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters were obtained. The printing plate was not damaged.

The sample of the present invention in which substrate 3 was used showed no change in the photosensitivity of the plate, the contact angle, and the restoration speed of the contact angle by heating, and the whiteness of the white background of the print surface was almost the same with the first print surface visually. On the other hand, in the comparative sample in which substrate 1 was used, ink-stain was observed on the second print surface. With respect to the reflection density of the white background, the sample according to the present invention in which substrate 3 was used showed the same reflection density as that on the first print surface, and the comparative sample in which substrate 1 was used showed the increase by 0.08.

It can be seen from these results that even when the printing plate precursor comprising an aluminum substrate having provided thereon a thin layer of $CsLa_2NbTi_2O_{10}$ having a thickness of 1,000 Å is used, a thin layer having the graining degree within the scope of the present invention diminishes ink-stain.

Example II-4

Samples were prepared using substrate 1 (Comparison) and substrate 3 (Invention) of aluminum substrate used in Example II-1 by providing a barium titanate thin layer thereon, and each sample was subjected to plate-making, printing, reclamation and the second printing in the same manner as in Example II-1.

Each of aluminum substrates 3 and 1 was set in a sputtering apparatus and evacuated to $5\times10^{-7}$ Torr. Each substrate was heated at 150° C., and the gas pressure of $Ar/O_2$ mixed gas (30/70 by molar ratio) was adjusted to $5\times10^{-3}$ Torr. RF power 200 W was applied to a barium titanate sintered target having a diameter of 6 inches, thus a barium titanate thin film having a film thickness of 1,000 Å was formed. The substrate was cut to a size of 510×400 mm to prepare a sample.

The surface of the barium titanate thin film of each sample was exposed at illumination intensity of 9 mW/cm$^2$ for 2 minutes using USIO printing light source apparatus, Unirec URM-600 model GH-60201X (manufactured by Ushio Electric Co., Ltd.).

Each sample was imagewise exposed with semiconductor laser beams of 830 nm diaphragmed to 45 $\mu$m in width ($1/e^2$ value) on the following conditions:

Scanning speed: 1.9 m/sec

Scanning pitch: 22.5 $\mu$m

Energy density: 785 mJ/cm$^2$

The printing plate imagewise drawn with a semiconductor laser beams of an infrared ray region was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters in which a laser-exposed part was converted to an ink-receiving area and the non-image area was not stained were obtained. The printing plate was not damaged.

After printing, the surface of each plate was cleaned carefully using waste impregnated with printing ink cleaner Dai-Clean R (manufactured by Dainippon Chemicals and Ink Co., Ltd.) to remove the ink. The printing plate was exposed at illumination intensity of 9 mW/cm for 2 minutes on the same conditions as in Example II-1 using USIO printing light source apparatus, Unirec URM-600 model GH-60201X (manufactured by Ushio Electric Co., Ltd.).

The surface of the sample was imagewise exposed with laser beams using the same semiconductor laser as used in Example II-1 except for differing the drawn images.

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.09 in optical reflection density.

Example II-5

Samples were prepared using substrate 1 (Comparison) and substrate 3 (Invention) of aluminum substrate used in Example II-1 (thickness: 100 $\mu$m) by providing a titanium oxide thin layer thereon, and each sample was subjected to plate-making, printing, reclamation and the second printing in the same manner as in Example II-1.

Each of aluminum substrates 3 and 1 was set in a vacuum deposition apparatus and a titanium metal piece was heated on the conditions of full pressure of $1.5\times10^{-4}$ Torr and oxygen gas partial pressure of 70%, thereby a titanium oxide thin film was formed by vapor-deposition. The crystal component of this thin film was revealed to have the crystal structure ratio of amorphous/anatase/rutile of 1.5/6.5/2 by X-ray analysis, and the $TiO_2$ thin film has a film thickness of 900 Å. The substrate was cut to a size of 510×400 mm to prepare a sample. These two precursors were set in an electrostatic photographic apparatus in place of recording paper and toner images were formed according to an electrostatic recording method. These samples of precursors were exposed at illumination intensity of 9 mW/cm$^2$ for 2 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

The surface of each plate was immersed in a mixed solvent of printing ink cleaner Dai-Clean R (manufactured by Dainippon Chemicals and Ink Co., Ltd.) and toluene in a proportion of 1/1. The image and the ink were dissolved and vanished within about 15 seconds. After the ink was removed by cleaning carefully, the plate was heated in an oven at 150° C. for 10 minutes to be restored to the original state.

In this condition, the plate was set in the same electrostatic photographic apparatus, and toner images different from the first images were formed according to an electrostatic recording method. Subsequently, the plate precursor sample was exposed using the same light source (USIO printing light source apparatus) at the same illumination intensity (9 mW/cm$^2$) for 2 minutes.

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.08 in optical reflection density.

Example II-6

Samples were prepared using substrate 1 and substrate 3 used in Example II-1 by providing a barium titanate thin layer thereon, and the following printing plates for thermal printing were prepared. Each substrate was cut to a size of 510×400 mm to prepare a sample.

Printing was performed using a heat-sensitive printer comprising thermal heads of a size of 150 μm×150 μm arranged with the intervals of 250 μm comprising a siaron wear-resisting protective layer provided on Ta-$SiO_2$ exothermic resistor. The barium titanate surface layer was brought into contact with the thermal heads and printing was performed by increasing the temperature. It was confirmed by measurement of the temperature conducted separately that the thermal head used reached 450° C. by the electric current application of 20 msec. The recording speed was 400 msec/m.

Commercially available thermal melting ink comprising 20% by weight of a pigment, 20% by weight of a carnauba wax, 40% by weight of an ester wax, 10% by weight of a linseed oil, and 10% by weight of a binder resin, and having a melting point of 62° C. was used.

Each of the samples was exposed at illumination intensity of 9 mW/cm$^2$ for 2 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 300 sheets, from beginning to end of printing, clear printed matters were obtained. The printing plate was not damaged.

After printing, the surface of each plate was cleaned carefully using waste impregnated with a mixed solvent of printing ink cleaner Dai-Clean R (manufactured by Dainippon Chemicals and Ink Co., Ltd.) and toluene in a proportion of 1/1 to remove the ink and image substance. Each plate was heated in an oven at 150° C. for 10 minutes.

In this condition, the plate was subjected to thermal transfer printing of a different image from the first time, and exposed at illumination intensity of 9 mW/cm$^2$for 2 minutes using the same light source (USIO printing light source apparatus).

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.): In the course of performing offset printing of 300 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of smearing of the white background increased from the initial stage of 500 sheet printing as compared with the first printing, although within an allowable level. The reflection density of the white background was increased by 0.06 in optical reflection density.

Example II-7

Samples were prepared using substrate 1 (Comparison) and substrate 3 (Invention) of aluminum substrate used in Example II-5 by depositing a titaniumoxide thin layer thereon. Each substrate was cut to a size of 510×400 mm to prepare a sample, and the following experiment was performed.

A design was drawn on the surface of the sample with an oil ink comprising 20% by weight of a copper phthalocyanine inorganic pigment as a colorant, 30% by weight of a linseed oil as a vehicle, 38% by weight of toluene as a solvent, 10% by weight of a polyethylene wax, and 2% by weight of a manganase drier. Each of the samples was exposed at illumination intensity of 9 mW/cm$^2$ for 2 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters were obtained. The printing plate was not damaged.

After printing, the surface of each plate was cleaned carefully using waste impregnated with a mixed solvent of printing ink cleaner Dai-Clean R (manufactured by Dainippon Chemicals and Ink Co., Ltd.) and toluene in a proportion of 1/1 to remove the ink. Each plate was heated in an oven at 180° C. for 2 minutes to be restored to the original state.

In this condition, a different image of a design from the first time was illustrated on the sample, and exposed at illumination intensity of 9 mW/cm$^2$ for 2 minutes using the same light source (USIO printing light source apparatus).

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.06 in optical reflection density.

Example II-8

Aluminum substrate 3 having a thickness of 100 $\mu$m was set in a vacuum deposition apparatus and zinc selenide was vacuum deposited in a thickness of 1,000 Å, which was subjected to oxidation treatment in the air at 600° C. for 2 hours, thereby a zinc oxide thin film was formed on one side of the substrate.

The substrate having a thickness of 100 $\mu$m, provided with a zinc oxide film, was cut to a size of 510×400 mm to prepare a sample. This sheet was set in an ink jet printer and an oil (based) ink image was recorded on the surface of the sheet. The oil (based) ink comprised 50 g of a latex dispersion of 10 weight parts of a vinyl acetate/methacrylate copolymer resin dispersed in 30 weight parts of Isopar H, 10 g of a dodecyl methacrylate/acrylic acid copolymer (95/5 by weight ratio), a dispersion of 10 g of alkali blue and 30 g of Shellsol 71, 10 g of tetradecyl alcohol, 0.16 g of an octacene/maleic acid octadecyl alcohol copolymer, and these components were diluted with 1 liter of Isopar G.

The sample was exposed at illumination intensity of 9 mW/cm$^2$ for 20 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

After printing, the surface of the plate was cleaned carefully using waste impregnated with a mixed solvent of printing ink cleaner Dai-Clean R (manufactured by Dainippon Chemicals and Ink Co., Ltd.) and toluene in a proportion of 1/1 to remove the ink. The plate was heated in an oven at 160° C. for 15 minutes to be restored to the original state.

In this condition, a different image from the first time was recorded on the plate using the above ink jet printer and the oil ink, and exposed at illumination intensity of 9 mW/cm$^2$ for 2 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 1,000 sheets, from beginning to end of printing, clear printed matters were obtained. The printing plate was not damaged.

Example II-9

Samples were prepared using substrate 1 (Comparison) and substrate 3 (Invention) of aluminum substrate used in Example II-5 by vapor-depositing a titanium oxide thin layer thereon. Each substrate was cut to a size of 510×400 mm to prepare a sample, and the following experiment was performed.

Each of aluminum substrates 3 and 1 was set in a vacuum deposition apparatus and a titanium metal piece was heated on the conditions of full pressure of $1.5\times10^{-4}$ Torr and oxygen gas partial pressure of 70%, thereby a titanium dioxide thin film was formed by vapor-deposition. The crystal component of this thin film was revealed to have the crystal structure ratio of amorphous/anatase/rutile of 1.5/6.5/2 by X-ray analysis, and the $TiO_2$ thin film has a film thickness of 900 Å. Each of the substrates was cut to a size of 510×400 mm to prepare a sample. Each precursor was set in an ink jet printer (Epson PM-700C) in place of recording paper and a water color ink image was formed. The water color ink comprised 7% by weight of glycerin, 8% by weight of diethylene glycol, 7% by weight of butyl ether, 1.5% by weight of C.I. Direct Green 1 (a water-soluble dye), 1.5% by weight of C.I. Direct Green 28 (a water-soluble dye), and 75% by weight of water. This polyethylene terephthalate (PE) film having an image was exposed at illumination intensity of 9 mW/cm$^2$ for 2 minutes using USIO printing light source apparatus, Unirec URM-600 model GH-60201X (manufactured by Ushio Electric Co., Ltd.). The film was washed with running water lightly to erase the image.

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

The surface of each plate was immersed in a mixed solvent of printing ink cleaner Dai-Clean R (manufactured by Dainippon Chemicals and Ink Co., Ltd.) and toluene in a proportion of 1/1. The ink was dissolved and removed within about 15 seconds. After the ink was removed by cleaning carefully, the plate was heated in an oven at 150° C. for 10 minutes to be restored to the original state.

In this condition, the plate was set in the same ink jet printer, and an ink image different from the first image was formed. Subsequently, the plate precursor sample was exposed using the same light source (USIO printing light source apparatus) at the same illumination intensity (9 mW/cm$^2$) for 2 minutes, and then the image was removed by washing with running water.

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.06 in optical reflection density.

Example II-10

Samples were prepared using substrate 1 (Comparison) and substrate 3 (Invention) of aluminum substrate used in Example II-5 by depositing a titanium oxide thin layer thereon. Each substrate was cut to a size of 510×400 mm to prepare a sample, and the following experiment was performed.

A matrix film obtained by printing a 400 line/inch positive image and tanning developing was brought into contact with each of the above precursors closely in a wet state, thereby silver salt/gelatin image was transferred. Each precursor was exposed at illumination intensity of 9 mW/cm$^2$ for 2 minutes using USIO printing light source apparatus, Unirec URM-600 model GH-60201X (manufactured by Ushio Electric Co., Ltd.), and the image was removed by squeezing lightly with a water-containing sponge.

This plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

The surface of each plate was cleaned carefully using waste impregnated with printing ink cleaner Dai-Clean R (manufactured by Dainippon Chemicals and Ink Co., Ltd.) to remove the ink. The plate was then heated in an oven at 150° C. for 10 minutes to be restored to the original state.

In this condition, image transfer was performed from the matrix having a different image from the first image. Subsequently, each plate was exposed using the same light source (USIO printing light source apparatus) at the same illumination intensity (9 mW/cm$^2$) for 2 minutes.

The plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, the sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.09 in optical reflection density.

Example II-11

Samples were prepared using substrate 1 (Comparison) and substrate 3 (Invention) of aluminum substrate used in Example II-5 by depositing a titanium oxide thin layer thereon. Each substrate was cut to a size of 510×400 mm to prepare a sample, and the following experiment was performed.

Each substrate having a titanium oxide thin layer was set in an ink jet printer (Epson PM-700C) in place of recording paper and a water color ink image was formed. The water color ink comprised 20% by weight of N-methylpyrrolidone, 20% by weight of diethylene glycol, 5% by weight of polyethylene glycol (molecular weight: 300), 5%by weight of C.I. Direct Black 19 (a water-soluble dye), and 50% by weight of water. This titanium oxide thin layer having an image was exposed at illumination intensity of 9 mW/cm$^2$ for 2 minutes using USIO printing light source apparatus, Unirec URM-600 model GH-60201X (manufactured by Ushio Electric Co., Ltd.).

This printing plate was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, clear printed matters were obtained. The printing plate was not damaged.

The surface of each plate was immersed in a mixed solvent of toluene/Cleanser of 1/1. The ink and the image were removed within about 15 seconds. However, it is thought that the image substance had been absorbed by the ink before immersion. After the ink was removed by cleaning carefully, the plate was heated in an oven at 150° C. for 10 minutes to be restored to the original state.

In this condition, the plate was set in the same ink jet printer, and an ink image different from the first image was formed. Subsequently, the plate precursor having an image was exposed using the same light source (USIO printing light source apparatus) at the same illumination intensity (9 mw/cm$^2$) for 2 minutes.

The printing plate imagewise exposed was set in Oliver 52 single-sided printer (manufactured by Sakurai Co., Ltd.), and printing was performed using pure water as a fountain solution and New Champion F Gloss 85 Chinese Ink (manufactured by Dainippon Chemicals and Ink Co., Ltd.). In the course of performing offset printing of 500 sheets, from beginning to end of printing, the F sample according to the present invention in which substrate 3 was used provided clear printed matters having the same reflecting density as that on the first print surface, and the printing plate was not damaged. On the other hand, in the comparative sample in which substrate 1 was used, the degree of stain of the white background increased from the initial stage of 500 sheet printing as compared with the first printing, although within an allowable level. The reflection density of the white background was increased by 0.09 in optical reflection density.

EFFECT OF THE INVENTION

The printing precursor according to the present invention comprises a surface thin layer mainly comprising photocatalytic metallic oxide and the surface of the thin layer has the graining degree of the average equivalent circle pore diameter of at least 1.0 $\mu$m. A printing image plane is formed by only imagewise exposure with active light. According to the method of the present invention, a developing solution is not required, clear printed image can be obtained by offset printing, used printing plates can be reclaimed by heat treatment, ink stain does not occur by the repeat use of the printing plate precursor, and the quality of the printed paper can be maintained.

While the invention has been described in detail and with reference to specific examples thereof, it will be apparent to one skilled in the art that various changes and modifications can be made therein without departing from the spirit and scope thereof.

What is claimed is:

1. An offset printing plate precursor comprising a substrate having provided thereon a thin layer, wherein printing is performed by following the steps of:

(a) subjecting the printing plate precursor to irradiation with active light, (b) subjecting the printing plate precursor to irradiation with light/heat convertible radiant rays, to thereby imagewise distribute a hydrophilic area and a lipophilic area of said thin layer, and (c) bringing said thin layer into contact with printing ink to form a printing plate in which the lipophilic area has received the printing ink, to thereby perform offset printing, wherein a layer containing a substance capable of absorbing radiant rays and converting the radiant energy to heat energy is provided between said thin layer and the substrate and in contact with said thin layer wherein said thin layer provided on the substrate is a thin layer composed of at least one compound selected from the group consisting of $TiO_2$, $RTiO_3$ (wherein R represents an alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to metal elements of Group V-A of the Periodic Table, E represents a metal atom belonging to metal elements of Group IV of the Periodic Table, and x represents an arbitrary numerical value of from 0 to 2), $SnO_2$, $Bi_2O_3$, and $Fe_2O_3$.

2. The offset printing plate precursor as claimed in claim 1, wherein the substance capable of absorbing radiant rays and converting the radiant energy to heat energy is a metal or a metal compound accompanied by a self exothermic reaction.

3. The offset printing plate precursor as claimed in claim 1, wherein said printing plate precursor can be restored to the original condition before use and repeatedly used by removing the remaining ink on the printing plate after printing has been finished by cleaning and then heating the surface of said plate precursor at 80° C. or higher.

4. The offset printing plate precursor as claimed in claim 1, wherein printing is performed by following the steps of (a) subjecting the printing plate precursor to irradiation with active light, (b) subjecting the printing plate precursor to heat treatment, to thereby imagewise vary the degree of hydrophilicity and lipophilicity of said thin layer, and (c) bringing said thin layer into contact with printing ink to form a printing plate in which the lipophilic area has received the printing ink, to thereby perform offset printing, and wherein the surface of said thin layer is a scabrous surface comprising concavities and convexities having an arithmetic mean pore diameter calculated in terms of circle of the concavities of at least 1.0 $\mu$m.

5. The offset printing plate precursor as claimed in claim 4, wherein printing is performed by following the steps of (a) subjecting the printing plate precursor to irradiation with active light, (b) subjecting the printing plate precursor to heat treatment, to thereby imagewise vary the degree of hydrophilicity and lipophilicity of said thin layer, and (c) bringing said thin layer into contact with printing ink to form a printing plate in which the lipophilic area has received the printing ink, to thereby perform offset printing, wherein said printing plate precursor can be restored to the original condition before use and repeatedly used by removing the remaining ink on the printing plate after printing has been finished by cleaning and then heating the surface of the plate precursor at 80° C. or higher.

6. An offset printing method which comprises:

(a) subjecting a printing plate precursor provided with a thin layer on the surface thereof to irradiation with active light, (b) subjecting the printing plate precursor to irradiation with light/heat convertible radiant rays, to thereby imagewise distribute a hydrophilic area and a lipophilic area of said thin layer, and (c) bringing said thin layer into contact with printing ink to form a printing plate in which the lipophilic area has received the printing ink, to thereby perform offset printing, wherein a layer containing a substance capable of absorbing radiant rays and converting the radiant energy to heat energy is provided between said thin layer and the substrate and in contact with said thin layer.

7. The offset printing method as claimed in claim 6, wherein said thin layer is a thin layer composed of at least one compound selected from the group consisting of $TiO_2$, $RTiO_3$ (wherein R represents a alkaline earth metal atom), $AB_{2-x}C_xD_{3-x}E_xO_{10}$ (wherein A represents a hydrogen atom or an alkali metal atom, B represents an alkaline earth metal atom or a lead atom, C represents a rare earth atom, D represents a metal atom belonging to metal elements of Group V-A of the Periodic Table, E represents a metal atom belonging to metal elements of Group IV of the Periodic Table, and x represents an arbitrary numerical value of from 0 to 2), $SnO_2$, $Bi_2O_3$, and $Fe_2O_3$.

8. The offset printing method as claimed in claim 6, wherein said substance capable of absorbing radiant rays and converting the radiant energy to heat energy is a metal or a metal compound accompanied by a self exothermic reaction.

9. The offset printing method as claimed in claim 6, wherein said printing plate precursor is restored to the original condition before use and repeatedly used by removing the remaining ink on the printing plate after printing has been finished by cleaning and then heating the surface of said plate precursor at 80° C. or higher.

10. The offset printing method as claimed in claim 6, comprises the steps of:

(a) subjecting all over the surface of the thin layer on the surface of the printing plate precursor to irradiation with active light to make all over the surface of the thin layer hydrophilic, (b) subjecting the surface of the thin layer to imagewise irradiation with light/heat convertible radiant rays to make the irradiated part lipophilic, and (c) bringing the surface of said thin layer into contact with printing ink to form a printing plate in which the lipophilic area has received the printing ink, to thereby perform offset printing.

11. The offset printing method as claimed in claim 6, wherein said printing plate precursor is repeatedly used by following the steps of:

(a) subjecting all over the surface of the thin layer on the surface of the printing plate precursor to irradiation with active light to make all over the surface of the thin layer hydrophilic, (b) subjecting the surface of the thin layer to imagewise irradiation with light/heat convertible radiant rays to make the irradiated part lipophilic, (c) bringing the surface of said thin layer into contact with printing ink to form a printing plate in which the lipophilic area has received the printing ink, to thereby perform offset printing, (d) removing the remaining ink on the surface of the thin layer after printing has been finished by cleaning, and (e) heating the surface of the thin layer at 80° C. or higher, thereby all over the surface of the thin layer is restored to its lipophilic condition.

12. The offset printing method as claimed in claim 6, wherein said printing plate precursor is repeatedly used by following the steps of:

(a) subjecting the printing plate precursor to irradiation with active light, (b) subjecting the printing plate precursor to heat treatment, to thereby imagewise distribute a hydrophilic area and a lipophilic area of said thin layer, (c) bringing said thin layer into contact with printing ink to form a printing plate in which the lipophilic area has received the printing ink, to thereby perform offset printing (d) removing the remaining ink on the printing plate after printing has been finished by cleaning, and (e) heating the surface of said plate precursor at 80° C. or higher, thereby said plate precursor is restored to the original condition before use and repeatedly used.

13. The offset printing method as claimed in claim 12, wherein said printing plate precursor is repeatedly used by following the steps of:

(a) subjecting all over the surface of the thin layer on the surface of the printing plate precursor to irradiation with active light to make all over the surface of the thin layer hydrophilic, (b) subjecting the surface of the thin layer to imagewise heating to make the irradiated part lipophilic, (c) bringing the surface of said thin layer into contact with printing ink to form a printing plate in which the lipophilic area has received the printing ink, to thereby perform offset printing, (d) removing the remaining ink on the surface of the thin layer after printing has been finished by cleaning, and (e) heating the surface of the thin layer at 80° C. or higher, thereby all over the surface of the thin layer is restored to its lipophilic condition.

14. The offset printing method as claimed in claim 12, wherein said printing plate precursor is repeatedly used by following the steps of:

(a) subjecting the surface of the thin layer on the surface of the printing plate precursor to imagewise irradiation with active light to make the irradiated part of the thin layer hydrophilic, (b) bringing the surface of said thin layer into contact with printing ink to form a printing plate in which the lipophilic area has received the printing ink, to thereby perform offset printing, (c) removing the remaining ink on the surface of the thin layer after printing has been finished by cleaning, and (d) heating the surface of the thin layer at 80° C. or higher, thereby all over the surface of the thin layer is restored to its lipophilic condition.

15. The offset printing method as claimed in claim 6, wherein the active light for use in imagewise irradiation is laser beam.

* * * * *